US011833093B2

(12) United States Patent
Tomita

(10) Patent No.: US 11,833,093 B2
(45) Date of Patent: Dec. 5, 2023

(54) TRANSFER DEVICE

(71) Applicant: Koubou Ryo, Inc., Kagoshima (JP)

(72) Inventor: Ryoichi Tomita, Kagoshima (JP)

(73) Assignee: KOUBOU RYO, INC., Kagoshima (JP)

( * ) Notice: Subject to any disclaimer, the term of this patent is extended or adjusted under 35 U.S.C. 154(b) by 244 days.

(21) Appl. No.: 17/596,707

(22) PCT Filed: Jun. 15, 2020

(86) PCT No.: PCT/JP2020/023489

§ 371 (c)(1),
(2) Date: Dec. 16, 2021

(87) PCT Pub. No.: WO2021/002187

PCT Pub. Date: Jan. 7, 2021

(65) Prior Publication Data

US 2022/0313522 A1 Oct. 6, 2022

(30) Foreign Application Priority Data

Jul. 3, 2019 (JP) ..... 2019-124083

(51) Int. Cl.

| | |
|---|---|
| ***A61G 7/10*** | (2006.01) |
| ***A61G 5/14*** | (2006.01) |
| ***A61G 5/12*** | (2006.01) |
| ***A61G 5/10*** | (2006.01) |

(52) U.S. Cl.

CPC ..... *A61G 7/1046* (2013.01); *A61G 5/10* (2013.01); *A61G 5/12* (2013.01); *A61G 5/14* (2013.01);

(Continued)

(58) Field of Classification Search

CPC .. A61G 7/1046; A61G 7/1048; A61G 7/1049; A61G 7/1092; A61G 7/1096;

(Continued)

(56) References Cited

U.S. PATENT DOCUMENTS 8,375,484 B2 * 2/2013 Ota ..... A61G 7/1017 5/81.1 R
2018/0280217 A1 * 10/2018 Batrice ..... A61G 5/127

FOREIGN PATENT DOCUMENTS

JP 2004181061 A * 7/2004
JP 2014-014573 A 1/2014

(Continued)

OTHER PUBLICATIONS

JP 2017148194—Eng Translation (Year: 2017).*
JP 2017023299—Eng Translation (Year: 2017).*
JP 2004181061—Eng Translation (Year: 2004).*
WO 2017134814—Eng Translation (Year: 2017).*
WO 2018131131—Eng Translation (Year: 2018).*

(Continued)

*Primary Examiner* — Justin C Mikowski
*Assistant Examiner* — Amanda L Bailey
(74) *Attorney, Agent, or Firm* — LUCAS & MERCANTI, LLP

(57) ABSTRACT

A transfer device can transfer a care-receiving person who has difficulty in independent walking to a desired location in a comfortable posture. This transfer device is provided with front wheels and rear wheels and allows a caregiver to move a care-receiving person. The transfer device is characterized by being provided with: a support body for supporting the upper half body of the care-receiving person; a leg guidance part that comes into contact with the anterior surface of the lower legs of the care-receiving person and can be tilted forward from a substantially vertical state; and a foot placement part on which the feet of the care-receiving person are placed. The transfer device has a support body advancing and retreating mechanism that is configured such that the support body moves forward in parallel in link with a forward tilt of the leg guidance part.

4 Claims, 13 Drawing Sheets

(52) U.S. Cl.
CPC ..... *A61G 7/1049* (2013.01); *A61G 7/1092* (2013.01); *A61G 7/1096* (2013.01); *A61G 7/1098* (2013.01)

(58) Field of Classification Search
CPC .... A61G 7/1098; A61G 7/1086; A61G 7/109; A61G 5/127; A61G 5/14; A61G 5/1013; A61G 5/1051; A61G 5/1037; A61G 5/125; A61G 5/128; A61G 5/00; A61G 5/02; A61G 5/10; A61G 5/12; A61G 5/124; A61G 5/157; A61G 7/10; A61G 7/1019; A61G 2203/70
See application file for complete search history.

(56) References Cited

FOREIGN PATENT DOCUMENTS

| | | | | | |
|---|---|---|---|---|---|
| JP | 2017023299 | A * | 2/2017 | ..... | A61G 5/00 |
| JP | 2017-148194 | A | 8/2017 | | |
| JP | 2017148194 | A * | 8/2017 | | |
| JP | 6504588 | B1 | 4/2019 | | |
| WO | WO-2017134814 | A1 * | 8/2017 | ..... | A61G 7/10 |
| WO | WO-2018131131 | A1 * | 7/2018 | ..... | A61G 5/14 |

OTHER PUBLICATIONS

PCT, International Search Report for the corresponding application No. PCT/JP2020/023489, dated Aug. 11, 2020, with English translation.

* cited by examiner

TRANSFER DEVICE

CROSS REFERENCE TO RELATED APPLICATION

This Application is a 371 of PCT/JP2020/023489 filed on Jun. 15, 2020, which, in turn, claims priority of the Japanese patent application no. 2019-124083, filed on Jul. 3, 2019, and the above applications are incorporated herein by reference.

TECHNICAL FIELD

The present invention relates to a transfer device capable of moving a care receiver who has difficulty in walking by himself/herself to a desired place in a comfortable posture.

BACKGROUND ART

Conventionally, among persons having illnesses or handicaps and aged persons, there are a large number of almost bed-ridden people who cannot move with his/her own wills to predetermined places for bathing or excretion (hereinafter referred to as "care receivers"). Such a care receiver is moved to a desired place with the help of a care giver. In such movement, the care giver makes the care receiver sit on an end portion of a bed or the like and, thereafter, the care giver moves the care receiver by carrying the care receiver or placing the care receiver on a wheelchair.

However, moving the care receiver by carrying the care receiver imposes a large burden on the care giver. Further, the care receiver is moved in an unstable state and hence, large physical and mental burdens are imposed on both the care receiver and the care giver.

Still further, in moving of a care receiver that requires the care receiver to get on and off a wheelchair, it is necessary for a care giver to carry the care receiver. In this case, also large physical and mental burdens are imposed on both the care receiver and the care giver.

Under such circumstances, for example, patent literature 1 discloses a transfer device that includes: a cart; a support strut that is tiltable in a frontward and backward direction at a position where the support strut is mounted on the cart in an erected manner; a chest support portion that is mounted on an upper portion of the support strut for supporting a chest of a care receiver; and a pair of shin support portions that are mounted on both sides of a lower portion of the support strut and supports shins of the care receiver respectively.

CITATION LIST

Patent Literature

[patent literature 1] JP-2014-014573 A

SUMMARY OF INVENTION

Technical Problem

Surely, the transfer device according to patent literature 1 is excellent from a viewpoint that, with the use of the transfer device, a care receiver in a seated posture is transferred to the transfer device relatively easily, and is moved to a desired place.

However, in the transfer device having such a configuration, at the time of transferring a care receiver on the transfer device, a chest of the care receiver is pressed to the chest support portion so that the support strut is inclined frontward whereby the care receiver is brought into a state where the care receiver rides on a back of the transfer device. That is, in the movement of the transfer device, a head of the care receiver always faces downward and hence, a large burden is imposed on the care receiver.

Further, the shin support portion does not support the behavior of the care receiver at the time of transferring. Accordingly, in transferring, it is necessary to incline the support strut frontward against a biasing force of a damper. Accordingly, in transferring, the care receiver places his/her weight of an unstable upper body on the chest support portion while firmly standing on a floor with his/her leg strength. For the care receiver having a weak leg strength who are estimated to use this device, to resist against a biasing force of the damper to an extent that the support strut is inclined frontward, a burden that is imposed on the care receiver is large and hence, there is a concern that the care receiver becomes mentally unstable.

The present invention has been made in view of the above-mentioned circumstances, and it is an object of the present invention to provide a transfer device capable of moving a care receiver who has difficulty in walking by himself/herself to a desired place in a comfortable posture.

Solution to Problem

To achieve the above-mentioned object, the present invention provides a transfer device having the following configurations.

According to the invention in claim 1, provided is a transfer device capable of moving a care receiver by a care giver, the transfer device includes: a front wheel and a rear wheel; a support body configured to support an upper body of the care receiver; a leg guide portion configured to be brought into contact with lower leg front surfaces of the care receiver and configured to be inclined frontward from an approximately vertical state; and a foot placing portion on which soles of the care receiver are placed; and a support body advancing and retracting mechanism configured to allow the support body to perform a translational movement in a frontward direction in an interlocking manner with frontward inclining of the leg guide portion and configured to allow the support body to perform the translational movement in a longitudinal direction without being interlocked with frontward inclining of the leg guide portion in a predetermined region where the support body performs the translational movement.

According to the invention in claim 2, in the transfer device according to claim 1, the support body is formed of a support strut portion erected upright and an upper body guide portion disposed on an upper end of the support strut portion, and the upper body guide portion includes a grip portion that the care receiver grips and a handle portion that the care giver grips for moving the transfer device.

According to the invention in claim 3, in the transfer device according to claim 2, the upper body guide portion includes: an arm placing portion formed approximately horizontally, the arm placing portion on which the care receiver places his/her elbows to front arms; a chest contact portion configured to be brought into contact with a chest of the care receiver and being inclined rearwardly downward, the chest contact portion being connected to a rear portion of the arm placing portion; and an elbow engaging portion that is formed on the chest contact portion as an integral part of the chest contact portion at the rear portion of the arm placing portion so as to make an upper end edge of the chest contact portion protrude upward with respect to a rear end portion of the arm placing portion.

According to the invention in claim 4, in the transfer device according to any one of claims 1 to 3, the support body advancing and retracting mechanism includes a support body brake configured to stop the translational movement of the support body.

Advantageous Effects of the Present Invention

According to the invention described in claim 1, the transfer device capable of moving a care receiver by a care giver, the transfer device includes: the front wheel and the rear wheel; the support body configured to support the upper body of the care receiver; the leg guide portion configured to be brought into contact with lower leg front surfaces of the care receiver and configured to be inclined frontward from the approximately vertical state; and the foot placing portion on which soles of the care receiver are placed; and the support body advancing and retracting mechanism configured to allow the support body to perform a translational movement in a frontward direction in an interlocking manner with frontward inclining of the leg guide portion and configured to allow the support body to perform the translational movement in a frontward and backward direction without being interlocked with frontward inclining of the leg guide portion in a predetermined region where the support body performs the translational movement. With such a configuration, in transferring the care receiver, when the care receiver simply brings lower leg front surfaces that form his/her lower body into contact with the leg guide portion and leans on the leg guide portion with his/her weight while gripping the support body, the support body performs the translational movement in a frontward direction, and the care receiver can also naturally lean on the support body with his/her upper body. Accordingly, the upper and lower bodies of the care receiver are supported at two points and hence, the stable posture of the care receiver on the transfer device is ensured.

Further, the support body performs a translational movement in a frontward direction and hence, there is no possibility that the head of the care receiver is directed downward. Accordingly, the upper body of the care receiver takes the stable posture substantially equal to the seated posture that the care receiver takes before the transfer operation and hence, the care receiver can maintain a comfortable posture during movement of the transfer device.

Further, in taking the care receiver off the transfer device, it is possible to bring the lower legs of the care receiver into an approximately upright state by merely pushing in the support body in a sitting direction. Accordingly, the care receiver can be seated on a chair in an extremely natural and comfortable posture.

Further, the support body performs the translational movement in the frontward direction and in the backward direction without being interlocked with frontward inclining of the leg guide portion in the predetermined region where the support body performs the translational movement in a frontward direction in an interlocking manner with the frontward inclining of the leg guide portion. Accordingly, movable range of the support body is expanded and hence, in transferring the care receiver to the transfer device or during movement of the transfer device, the care receiver can maintain the more comfortable posture. Such a structure is also effective in smoothly taking the care receiver off the transfer device.

According to the invention described in claim 2, the support body is formed of the support strut portion erected upright and the upper body guide portion disposed on the upper end of the support strut portion, and the upper body guide portion includes the grip portion that the care receiver grips and the handle portion that the care giver grips for moving the transfer device. With such a configuration, in transferring the care receiver to the transfer device and during movement of the transfer device, the care receiver can prevent himself/herself from falling from the transfer device by merely gripping the grip portion thus ensuring safety. Further, the care giver can safely operate the transfer device by merely gripping the handle portion.

According to the invention described in claim 3, the upper body guide portion includes: the arm placing portion formed approximately horizontally, the arm placing portion on which the care receiver places his/her elbows to front arms; the chest contact portion configured to be brought into contact with a chest of the care receiver and being inclined rearwardly downward, the chest contact portion being connected to the rear portion of the arm placing portion; and an elbow engaging portion that is formed on the chest contact portion as an integral part of the chest contact portion at the rear portion of the arm placing portion so as to make an upper end edge of the chest contact portion protrude upward with respect to a rear end portion of the arm placing portion. With such a configuration, in transferring the care receiver to the transfer device and during movement of the transfer device, the care receiver can make his/her elbows engage with the elbow engaging portion by merely placing his/her front arms on the arm placing portion and hence, the care receiver can stably lean on the transfer device with his/her upper body.

The front arms of the care receiver are placed on the substantially horizontal arm placing portion and hence, the upper body of the care receiver is not frontwardly inclined more than necessary and hence, the care receiver can maintain a comfortable posture during the movement of the transfer device.

According to the invention described in claim 4, the support body advancing and retracting mechanism includes the support body brake configured to stop the translational movement of the support body. Accordingly, the care giver can perform an operation of transferring the care receiver to the transfer device and an operation of taking the care receiver off the transfer device while adjusting an amount of translational movement of the support body that is associated with a degree of inclination of the lower legs of the care receiver.

DESCRIPTION OF EMBODIMENT

A transfer device according to the invention is a transfer device capable of moving a care receiver by a care giver. The transfer device includes: a front wheel and a rear wheel; a support body configured to support an upper body of the care receiver; a leg guide portion configured to be brought into contact with lower leg front surfaces of the care receiver and configured to be inclined frontward from an approximately vertical state; and a foot placing portion on which soles of the care receiver are placed; and a support body advancing and retracting mechanism configured to allow the support body to perform a translational movement in a frontward direction in an interlocking manner with frontward inclining of the leg guide portion. That is, the preset invention intends to provide the transfer device capable of moving a care receiver who has difficulty in walking by himself/herself to a desired place in a comfortable posture.

In the description made hereinafter, with respect to a longitudinal direction of the transfer device 1, a right side in FIG. 2, that is, a support body 6 side is set as a front side, and a left side, that is, a foot placing portion 22 side is set as a rear side.

Hereinafter, a transfer device 1 according to an embodiment of the present invention is described with reference to drawings. In the description made hereinafter, the structures and parts that are equal on left and right sides or structures and parts that are symmetrical on left and right sides are given same symbols in principle, and the structures and the parts on only one of left and right sides are described. The description of the structures and the parts on the other side is omitted when necessary.

Figure 1:
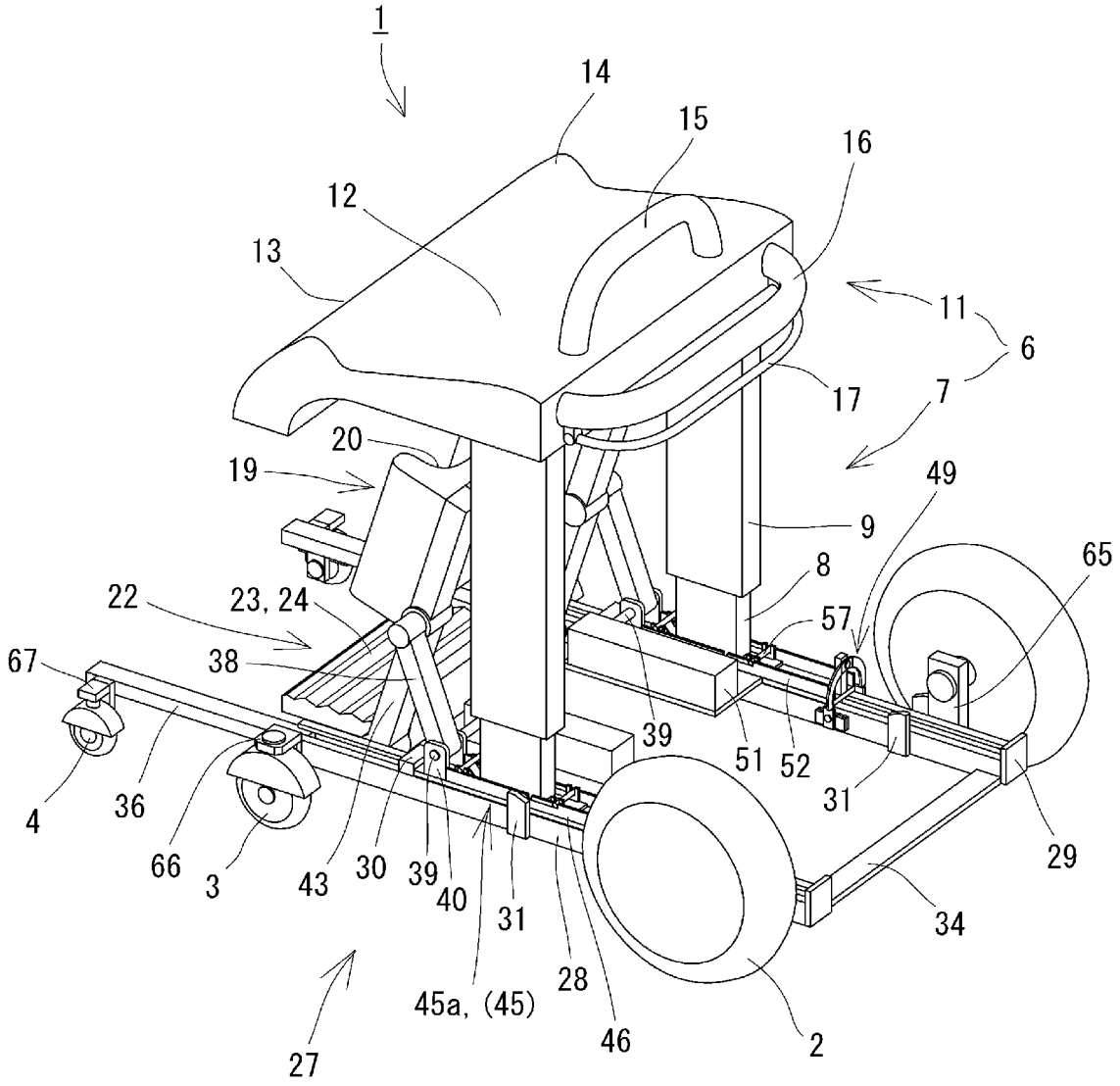
FIG. 1 is a perspective view of a transfer device according to an embodiment as viewed from an upper side where a leg guide portion is in an approximately vertical state.
Figure 2:
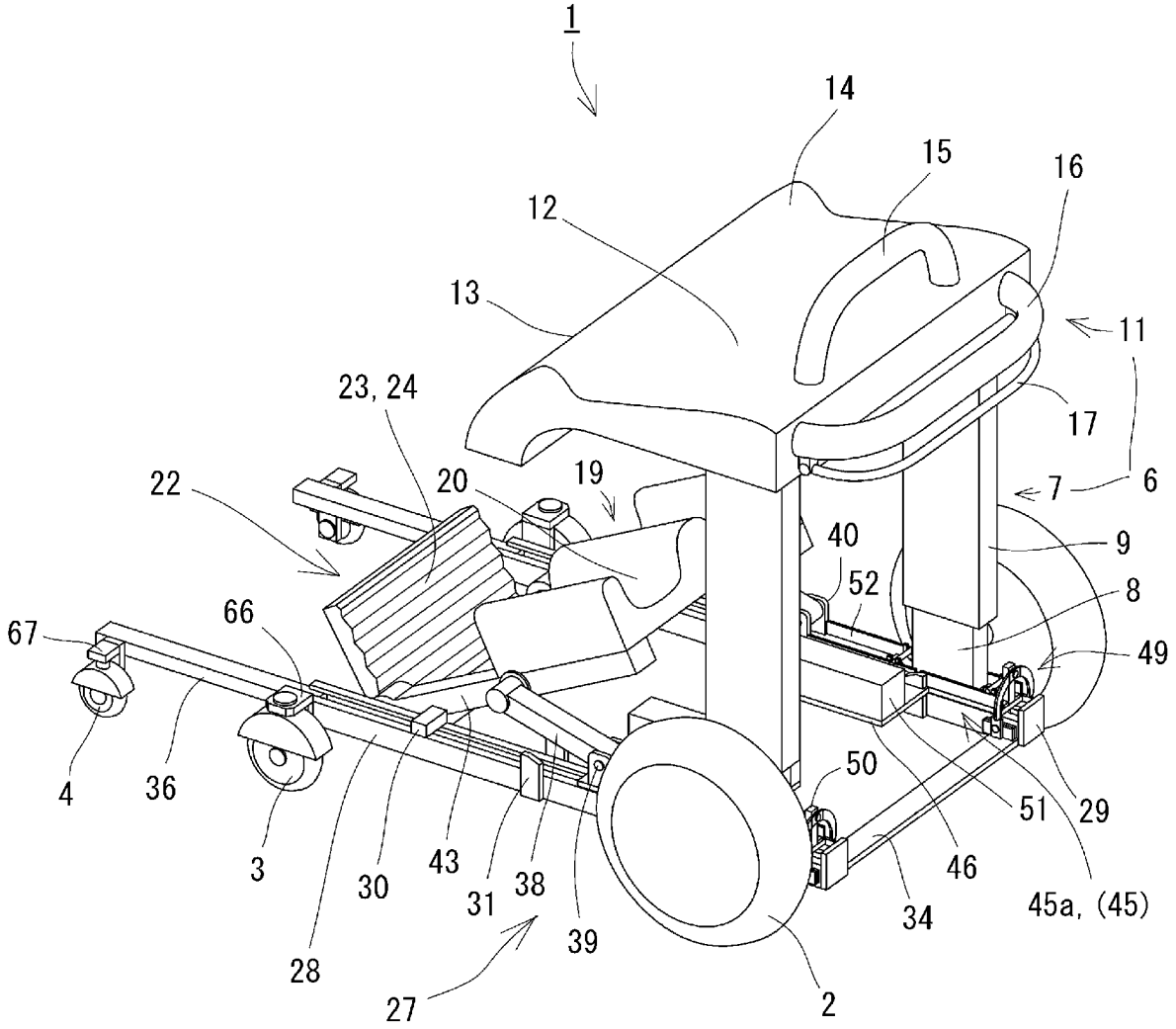
FIG. 2 is a perspective view of the transfer device according to the embodiment as viewed from an upper side where the leg guide portion is in an inclined state.

As shown in FIG. 1 and FIG. 2, the transfer device 1 according to the embodiment of the present invention is capable of moving a care receiver H by a care giver. The transfer device 1 includes: front wheels 2 and rear wheels 3; a support body 6 that supports an upper body of the care receiver H; a leg guide portion 19 that is brought into contact with lower leg front surfaces f of the care receiver H and is inclinable frontward from an approximately vertical state; and a foot placing portion 22 on which soles of the care receiver H are placed; and a support body advancing and retracting mechanism 27 that allows the support body 6 to perform a translational movement in a frontward direction in an interlocking manner with frontward inclining of the leg guide portion 19.

The support body 6 is formed of support strut portions 7 that are erected upright and an upper body guide portion 11 that is disposed on upper ends of the support strut portions 7. The upper body guide portion 11 includes a grip portion 15 that the care receiver H grips, and a handle portion 16 that a care giver grips for moving the transfer device 1.

Further, the upper body guide portion 11 includes: an arm placing portion 12 that is formed approximately horizontally and on which the care receiver H places his/her elbows to front arms; a chest contact portion 13 that is brought into contact with a chest of the care receiver H, is inclined rearwardly downward, and is connected to a rear portion of the arm placing portion 12; and an elbow engaging portion 14 that is formed on the chest contact portion 13 as an integral part of the chest contact portion 13 at the rear portion of the arm placing portion 12 so as to make an upper end edge of the chest contact portion 13 protrude upward with respect to a rear end portion of the arm placing portion 12.

Further, the support body advancing and retracting mechanism 27 includes: a support body brake 49 that can stop the translational movement of the support body 6; and a wheel brake that stops the rotation of the front wheels 2 or the rear wheels 3.

With such a configuration, in transferring the care receiver H, when the care receiver H simply brings lower leg front surfaces that form his/her lower body into contact with the leg guide portion 19 and leans on the leg guide portion 19 with his/her weight while gripping the support body 6, the support body 6 performs the translational movement in a frontward direction, and the care receiver H can also naturally lean on the support body 6 with his/her upper body. Accordingly, the upper and lower bodies of the care receiver H are supported at two points and hence, the stable posture of the care receiver H on the transfer device 1 is ensured.

Further, the support body 6 performs a translational movement in a frontward direction and hence, there is no possibility that the head of the care receiver H is directed downward. Accordingly, the upper body of the care receiver H takes the stable posture substantially equal to the seated posture that the care receiver H takes before the transfer operation and hence, the care receiver H can maintain a comfortable posture during movement of the transfer device 1.

Further, in taking the care receiver H off the transfer device 1, it is possible to bring the lower legs of the care receiver H into an approximately upright state by merely pushing the support body 6 in a sitting direction and hence, the care receiver H can be seated in an extremely natural and comfortable posture.

That is, the technique of the present invention can easily change the motion of the body in a comfortable posture by merely inclining or by approximately erecting upright the lower legs of the care receiver H on the transfer device 1.

Hereinafter, the constitutions of respective parts of the transfer device 1 according to this embodiment are specifically described in detail with reference to drawings.

As shown in FIG. 1, the transfer device 1 includes two front wheels 2, two rear wheels 3 having a smaller diameter than the front wheels 2, and two auxiliary wheels 4 having a smaller diameter than the rear wheels 3. The front wheels 2 are rotatably and pivotally supported by means of front bearing portions 65 on front outer side edges of rail portions 28 that are disposed parallel to each other in a lateral direction in a spaced-part manner.

The rear wheels 3 are rotatably and pivotally supported by means of rear bearing portions 66 on rear outer side edges of the rail portions 28. The auxiliary wheels 4 are rotatably and pivotally supported by means of auxiliary bearing portions 67 on rear outer side edges of extension stays 36 that are formed in an insertable manner into the rail portions 28 from rear ends of the rail portions 28.

Figure 3:
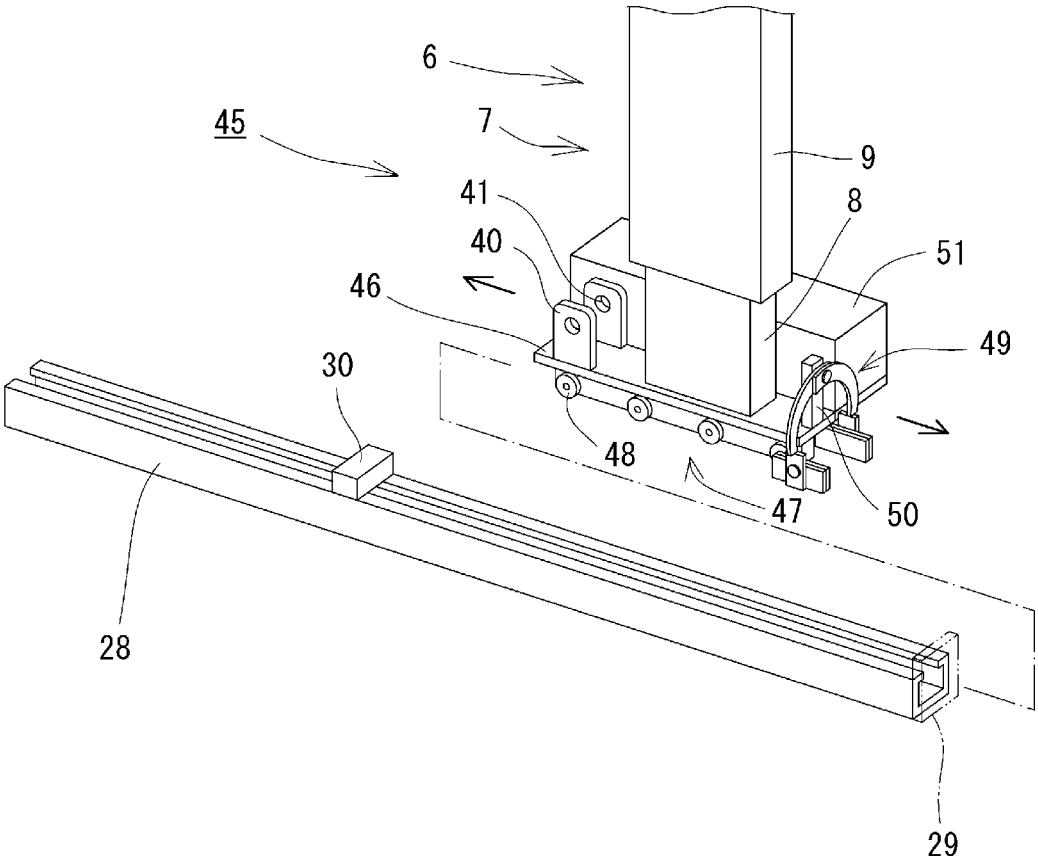
FIG. 3 is an explanatory view showing a support strut base portion and a rail portion of the transfer device according to the embodiment.

The rail portion 28 is formed of, as shown in FIG. 3, an elongated member having an approximately C-shaped transverse cross section having an opening on an upper side. The rail portion 28 is formed such that a slide portion 47 of a support strut base portion 45 described later is movable in the rail portion 28 in a longitudinal direction. A sealing member 29 that closes an opening formed on a front end of the rail portion 28 is provided for preventing the support strut base portion 45 from protruding from the front end of the rail portion 28. A rear stopper 30 having a rectangular shape that strides over the opening is disposed on an upper surface of a rear-side intermediate portion of the rail portion 28 so as to restrict the movement of the support strut base portion 45 in a rearward direction.

Figure 12:
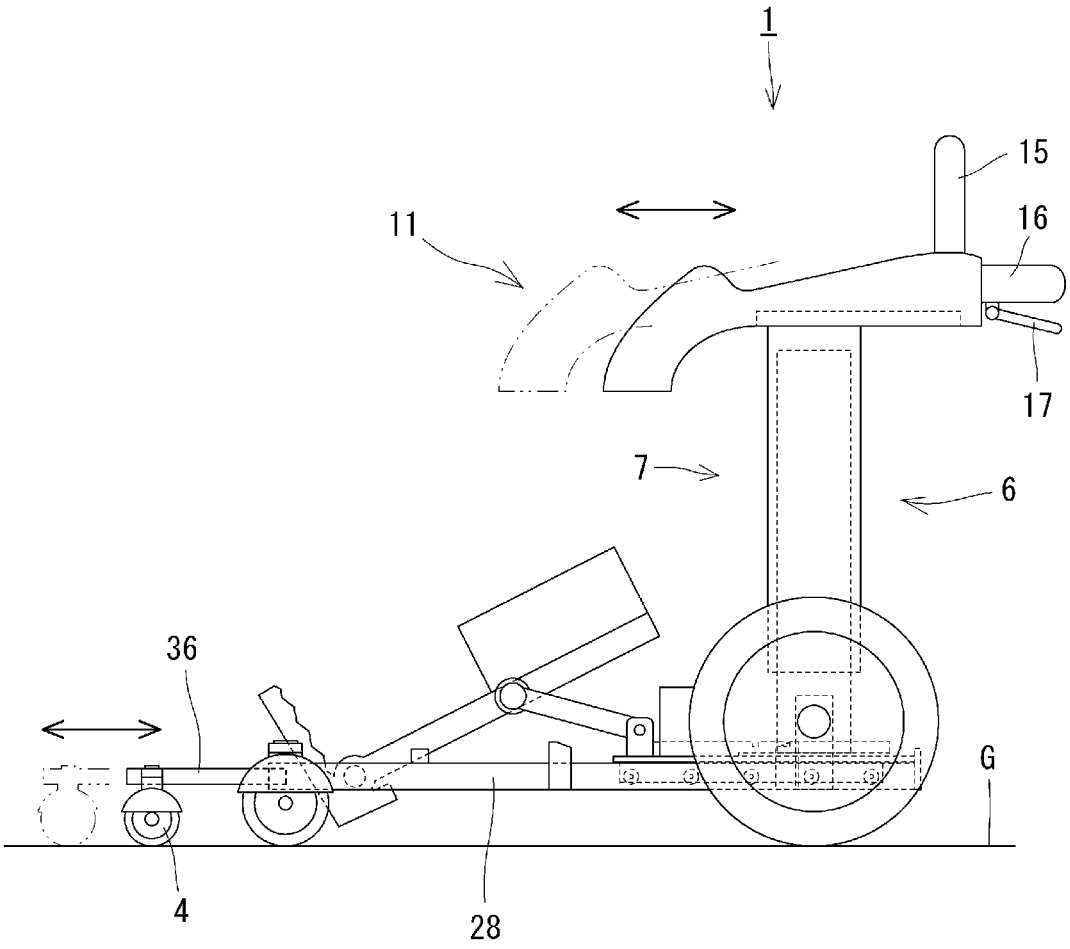
FIG. 12 is a side view for describing the extension and shrinkage of an extension stay and a longitudinal movement of an upper body guide portion of the transfer device according to the embodiment.

As shown in FIG. 1, the extension stay 36 on which the auxiliary wheel 4 is mounted is formed of an elongated rod having a rectangular cross-sectional shape that is substantially equal to the shape of the opening formed on the rear end of the rail portion 28. With such a configuration, as shown in FIG. 12, the extension stay 36 is insertable into the rail portion 28 with no play therebetween. Further, the extension stay 36 includes an extension stay fixing portion (not shown in the drawings) that fixes the extension stay 236 at any desired position with respect to the rail portion 28.

There may be a case where the extension stays 36 and the auxiliary wheels 4 interfere with an object on which the care receiver H is seated depending on the object such as a chair C and hence, the transfer device 1 cannot be positioned at desired portions. Accordingly, the extension stays 36 and the auxiliary wheels 4 are not indispensable constitutional elements. However, in a case where the transfer device 1 becomes unstable because of positioning of the center of gravity of the transfer device 1 on a rear side in a state where the care receiver H rides on the transfer device 1, it is desirable to provide the extension stays 36 and the auxiliary wheels 4 to the transfer device 1. In this case, it is desirable that the extension stays 36 and the auxiliary wheels 4 are formed as low and small as possible.

It is desirable that a brake that stops the rotation is provided to the front wheels 2, the rear wheels 3 and the auxiliary wheels 4 respectively. The brake may have the structure that is provided to the respective wheels 2, 3 and 4 independently and manually operated. Alternatively, a wire type disc brake that is used in a general-use bicycle or the like may be provided together with a handle to a portion in the vicinity of the handle portion 16 described later that a care giver operates. Further, the brake may be a brake having any structure that can substantially fix the wheels.

As shown in FIG. 1, the support body advancing and retracting mechanism 27 is formed of: front inclined stays 38 and rear inclined stays 43 that are disposed on left and right sides of the transfer device 1 and are formed of an angular rod; and the support strut base portion 45. Stay shafts 39 are integrally formed on left and right sides of one end edge portion of each front inclined stay 38 in a protruding manner, and one end portion of each front inclined stay 38 is rotatably and pivotally connected to the support strut portion 7 by way of the support strut base portion 45 that is disposed longitudinally movably in the rail portion 28. One end edge portion of each rear inclined stay 43 is rotatably and pivotally connected to a rear inner side of the rail portion 28. Further, the other end portion of each front inclined stay 38 is rotatably and pivotally connected to an intermediate portion of each rear inclined stay 43.

As shown in FIG. 3, the support strut base portion 45 includes: a base 46 having a rectangular plate shape and positioned above the rail portion 28; and the slide portion 47 that is disposed on a lower side of the base 46 and on which a plurality of rollers 48 that are slidably and rotatably brought into contact with an inner bottom portion of the rail portion 28. A lower support strut 8 that forms a part of the support strut portion 7 is mounted on an approximately center portion of the base 46 in an erected manner. On a front side of the support strut base portion 45, the support body brake 49 that can stop a longitudinal movement of the support strut base portion 45 by clamping left and right side surfaces of the rail portion 28 is fixed to an upper edge of a brake support portion 50 formed of a rod having a rectangular cross section.

In this embodiment, the case is shown where the support body brake 49 is a wire type disc brake that is used in a general-use bicycle or the like. However, provided that a mechanism can stop a longitudinal movement of the support strut base portion 45, various modifications and alterations are conceivable within the scope of the gist of the present invention.

Stay bearings 40 having a rectangular plate shape are formed in an erected manner on a rear side of the base 46 in an opposedly facing manner. Shaft holes 41 are formed in the stay bearings 40, and stay shafts 39 that are integrally formed on one end edge portion of the front inclined stay 38 shown in FIG. 1 are loosely fitted into the shaft holes 41. That is, the stay shaft 39 is rotatably and pivotally supported on the stay bearing 40. A damper device 51 is also mounted on the base 46. The damper device 51 is provided for imparting a load at the time of inclining the leg guide portion 19 frontward as indicated in FIG. 2 from an approximately vertical state shown in FIG. 1. Reversely, when the leg guide portion 19 returns from the inclined state to the approximately vertical state, the damper device 51 supports such an operation.

It is sufficient that the damper device 51 is operated in response to the rotation of the stay shaft 39. Accordingly, a general-use biasing mechanism such as a shock absorber that is formed of an oil damper or a pneumatic damper, for example, a device such as a door closer can be used.

The support strut base portion 45 described above is the basic configuration of the support body advancing and retracting mechanism 27 according to the present invention. That is, the support strut base portion 45 is the configuration where the support body 6 directly moves on a one-to-one basis in an interlocking manner with frontward inclining of the leg guide portion 19 from an approximately vertical state. As the configuration of the more complicated support strut base portion 45*a*, in a predetermined region where the support body 6 performs the translational movement in a frontward direction in an interlocking manner with frontward inclining of the leg guide portion 19, the support body 6 may perform translational movement in a longitudinal direction without being interlocked with the frontward inclining of the leg support portion 19. Accordingly, in the description made hereinafter, the description is made by mainly focusing on this configuration.

Figure 4:
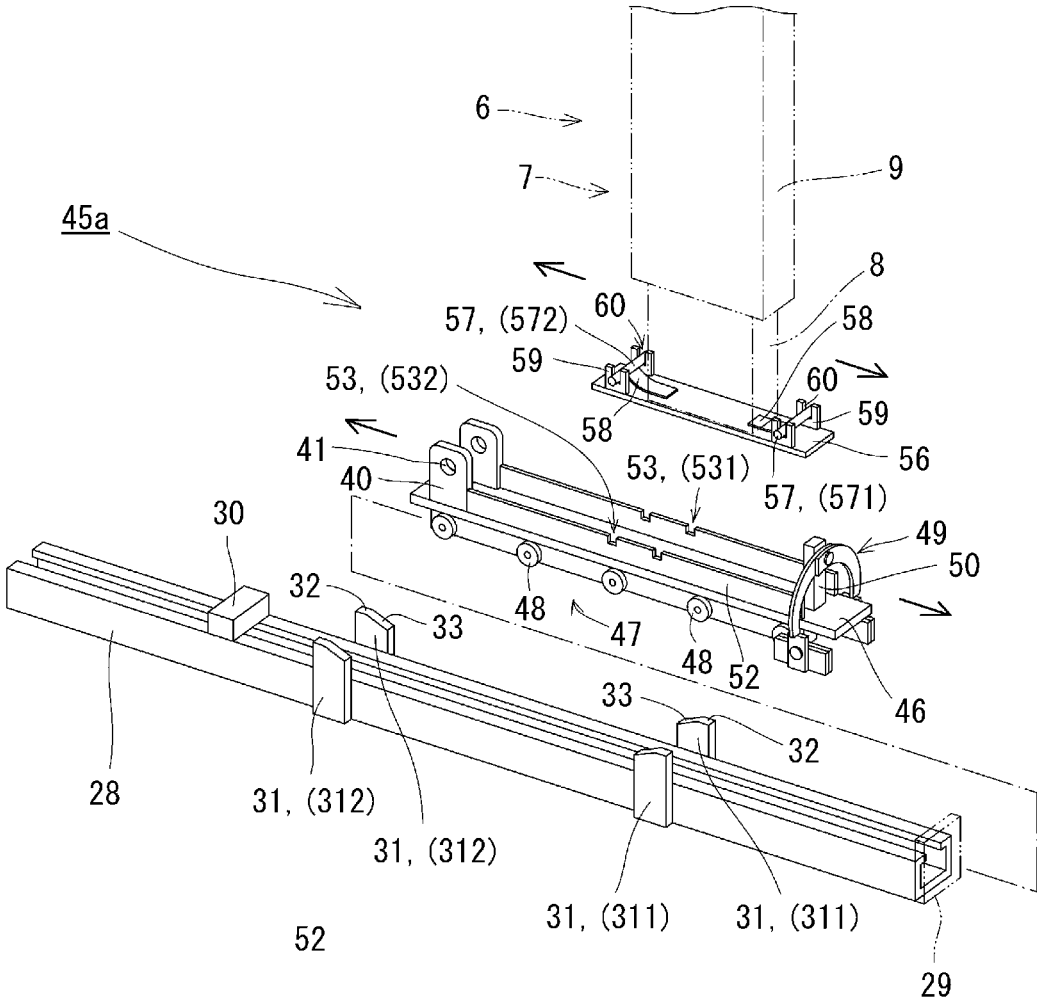
FIG. 4 is an exploded explanatory view showing the support strut base portion and the rail portion of the transfer device according to the embodiment.
Figure 5:
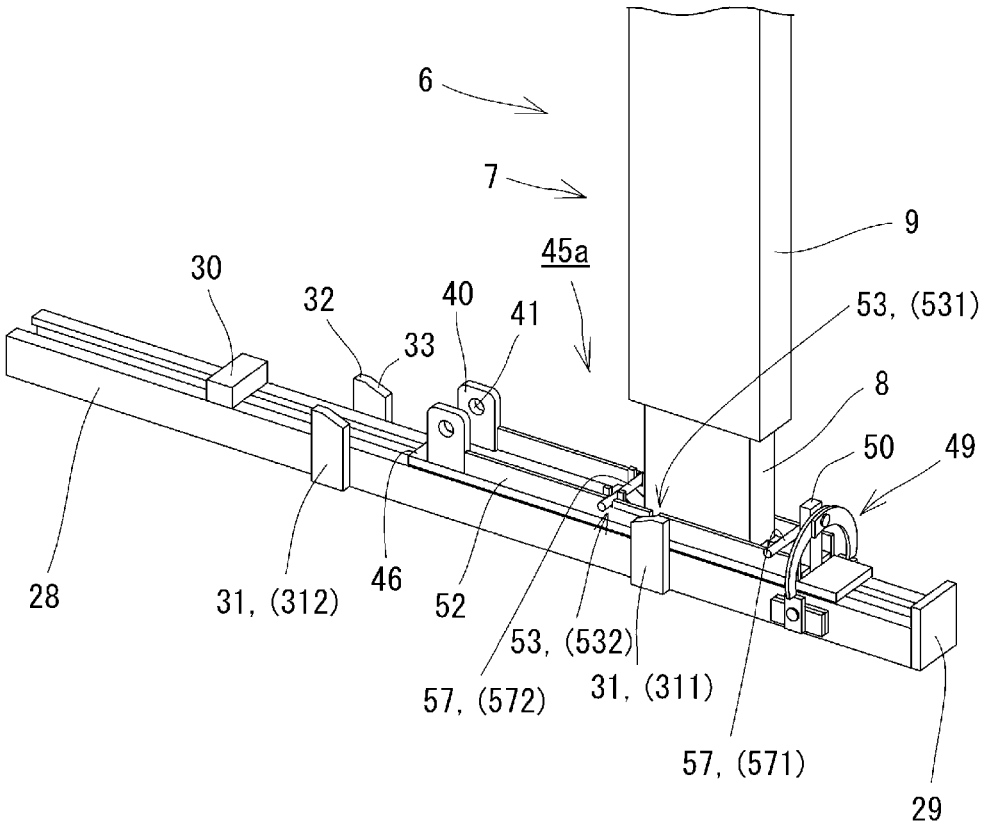
FIG. 5 is an explanatory view showing the support strut base portion and the rail portion of the transfer device according to the embodiment.

This support strut base portion 45*a* is, as shown in FIG. 4 and FIG. 5, compared to the support strut base portion 45 having the above-mentioned basic configuration shown in FIG. 3, guide plates 52 having an elongated plat shape that face each other are mounted on the base 46 in front of two stay bearings 40 that are mounted in an erected manner on the rear side of the base 46, and a movable base 56 having a rectangular plate shape on which the lower support strut 8 is mounted in an erected manner is disposed between two guide plates 52, and the movable base 56 can move in a longitudinal direction with respect to the base 46.

Engaging grooves 53 having a rectangular recessed shape that engage with engaging pins 57 are formed on an upper end of the guide plate 52. More specifically, a first engaging groove 531 and a second engaging grooves 532 are formed in the vicinity of an intermediate portion of the upper end of the guide plate 52 with a distance between the first and second engaging groove 531, 532. The first engaging groove 531 is formed on a front side and the second engaging grooves 532 is formed on a rear side. One end portions of leaf springs 58 having a rectangular shape are fixed to front and rear end edge portions of the movable base 56. Engaging pins 57 having a round rod shape that engage with the first and second engaging grooves 531, 532 are contiguously formed on the other end portions of the leaf springs 58 in a state where the axes of the engaging pins 57 are positioned in the lateral direction. Pin receiving bases 59 are mounted in an upright manner on the movable base 56 in an oppositely facing manner. The pin receiving bases 59 each have an approximately U shape and each form a support groove 60 having an upper opening, and the pin receiving bases 59 support left and right end edge portions of the engaging pin 57 at their upper portions. With such a configuration, the leaf springs 58 bias the engaging pin 57 in a downward direction.

The shape of the support grooves 60 formed in the pin receiving bases 59 has substantially equal to the shape of the engaging grooves 53. In a state where the movable base 56 is mounted on the base 46, the support grooves 60 and the engaging grooves 53 are formed so as to communicate with each other at the same height, and a length of the engaging pin 57 is set such that both ends of the engaging pin 57 protrude to the outside of the guide plates 52.

The engaging pin 57 that is contiguously formed on the leaf spring 58 on a front side is referred to as a first engaging pin 571, and the engaging pin 57 that is contiguously formed on the leaf spring 58 on a rear side is referred to as a second engaging pin 572.

On an upper surface of the base 46 positioned between two guide plates 52 and the lower bottom surface of the movable base 56, a slid member not shown in the drawing is laminated. The slide member is provided so as to ensure the smooth longitudinal slide movement of the movable base 56 on the base 46 by lowering a friction between the movable base 56 and the base 46 that are brought into contact with each other. Besides such a configuration, for example, various modifications and alterations are conceivable such as the arrangement of a slide mechanism such as rollers mounted on a lower bottom surface of the movable base 56.

The slide portion 47 formed on a lower side of the base 46 and the support body brake 49 disposed on a front side of the base 46 are substantially equal to the corresponding parts of the support strut base portion 45 having the basic configuration shown in FIG. 3. Further, the damper device 51 that is operated in response to the rotation of the stay shaft 39 integrally formed with the front inclined stay 38 is also disposed in the periphery of the stay bearing 40. In FIG. 4 to FIG. 10, the illustration of the damper device 51 is omitted.

Engaging guide members 31 having a rectangular plate shape and having an inclined upper end are disposed on both side surfaces of the rail portion 28. The engaging guide members 31 are provided for making the first and second engaging pins 571, 572 of the support strut base portion 45*a* engage with the first and second engaging grooves 531, 532 and for releasing the engagement between the first and second engaging pins 571, 572 and the first and second engaging grooves 531, 532 in the strut base portion 45*a*.

More specifically, as shown in FIG. 4 and FIG. 5, the engaging guide member 31 is configured such that, between the sealing member 29 and the rear stopper 30 formed on the rail portion 28, the first engaging guide members 311 are disposed in an opposedly facing manner with the rail portion 28 interposed therebetween at a front side of the rail portion 28 and, in the same manner, and the second engaging guide members 312 are disposed in an opposedly facing manner with the rail portion 28 interposed therebetween at a rear side of the rail portion 28.

The upper end of the first engaging guide member 311 has: a flat portion 32 having the same height as the guide plate 52 on a front side; and an inclined portion 33 that extends toward a rear side from the flat portion 32 in a downwardly inclined manner to a position that has at least substantially the same height as bottom portions of the first and second engaging grooves 531, 532.

The upper end of the second engaging guide member 312 has: an inclined portion 33 that extends rearward in an upwardly inclined manner from a position that has at least substantially the same height as the bottom portions of the first and second engaging grooves 531, 532 on a front side; and a portion having the same height as the guide plate 52 as a flat portion 32. That is, the first and second engaging guide members 311, 312 are symmetrically arranged on one side surface of the rail portion 28.

In this manner, with respect to the engaging guide members 31 for making the engaging pins 57 engage with the engaging grooves 53 and for releasing the engagement between the engaging pin 57 and the engaging grooves 53, for example, when the first and second engaging pin 571, 572 engage with neither the first engaging groove 531 nor the second engaging groove 532, that is, when the movable base 56 is movable in a longitudinal direction on the base 46 in a longitudinally movable state, either one of the first or second engaging pins 571, 572 never fails to engage with either one of the first or second engaging grooves 531, 532 so that the movable base 56 moves integrally with the base 46 in the longitudinal direction. Then, when the engaging pin 57 that engages with the engaging groove 53 is firstly brought into contact with the inclined portion 33 of the engaging guide member 31 along with the movement of the base 46 in the longitudinal direction, the engaging pin 57 moves upward so that the engagement between the engaging pin 57 and the engaging groove 53 is released. Accordingly, the movable base 56 can move on the base 46 in a longitudinal direction.

The engaging pin 57 that does not engage with the engaging groove 53 only passes on the flat portion 32 of the engaging guide member 31 even when the base 46 moves in the longitudinal direction. Accordingly, in a strict sense, the engaging guide member 31 is a member that releases the engaging pin 57 from the engaging groove 53, and the engagement of the engaging pin 57 with the engaging groove 53 is performed by moving the movable base 56 on the base 46 in the longitudinal direction irrelevant to the engaging guide member 31.

By forming the support strut base portion 45*a* in this manner, in a situation where none of the engaging pins 57 engage with the engaging groove 53, the movable base 56 is movable on the base 46 in the longitudinal direction. On the other hand, even when only one engaging pin 57 engages with the engaging groove 53, the movable base 56 becomes integral with the base 46 and hence, the movement of the support body 6 is directly connected with the longitudinal movement of the base 46.

For the sake of convenience of the description, the configuration is shown as FIG. 5 where the movable base 56 is mounted on the base 46 shown in FIG. 4 from above. However, it is needless to say that various configurations are added so as to prevent the easy removal of the movable base 56 from the base 46.

Hereinafter, the flow of an operation of the support body 6 formed of a plurality of steps and performed by the configuration of the support strut base portion 45*a* described above is described in detail with reference to FIG. 6 to FIG. 8.

Figure 6A:
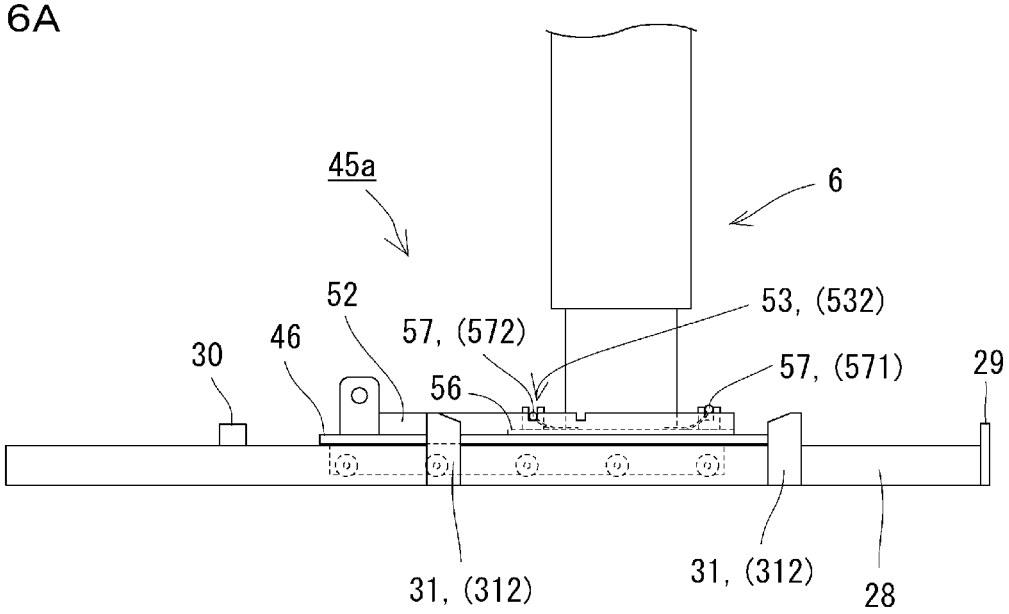
FIG. 6A and FIG. 6B are explanatory side views showing the relationship of engaging pins and the like that changes depending on the position of the support strut base portion of the transfer device according to the embodiment.
Figure 6B:
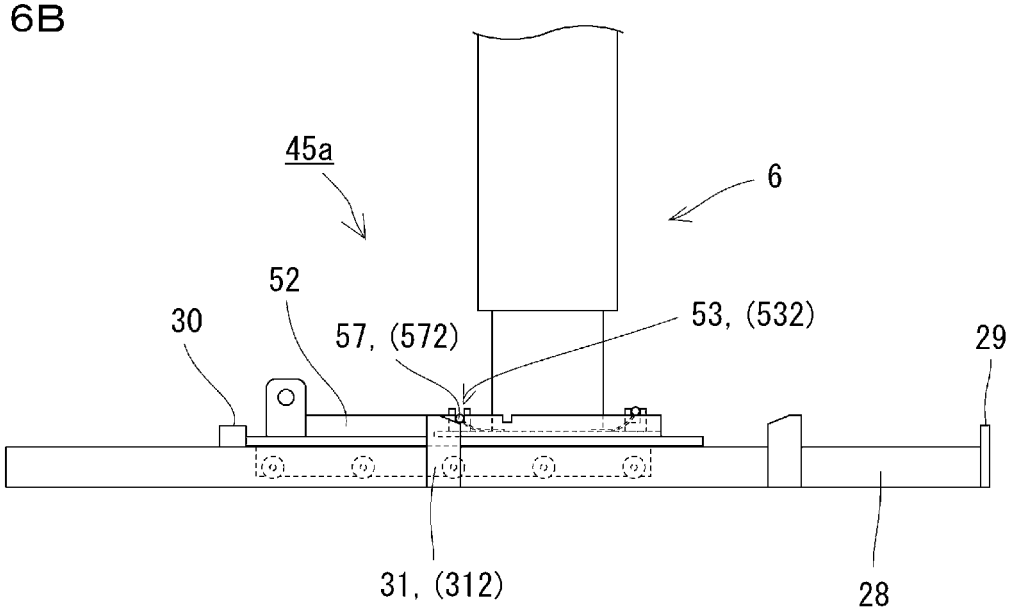
Figure 7A:
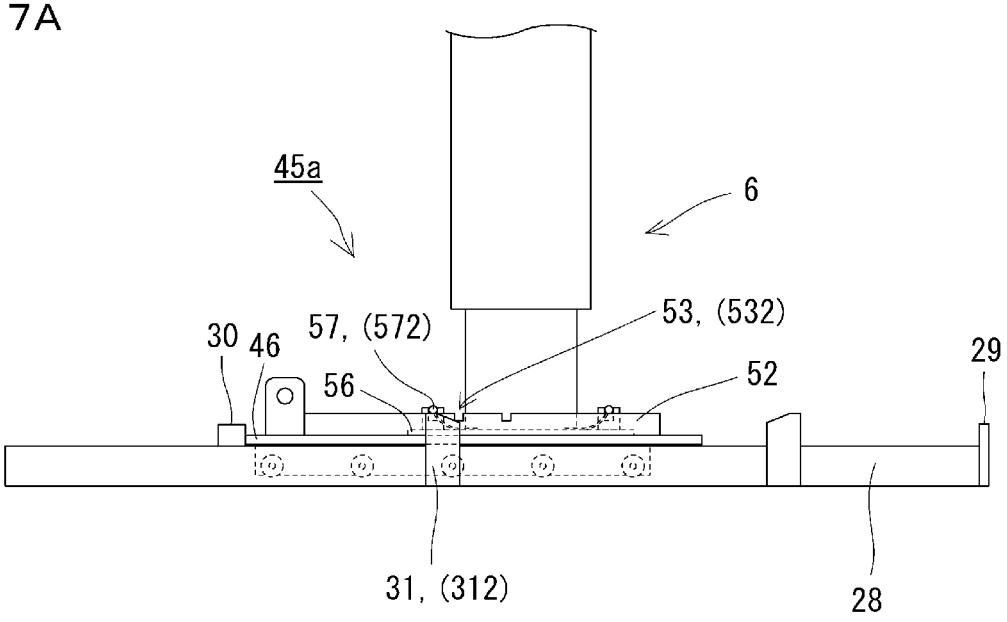
FIG. 7A and FIG. 7B are explanatory side views showing the relationship of the engaging pins and the like that changes depending on the position of the support strut base portion of the transfer device according to the embodiment.
Figure 7B:
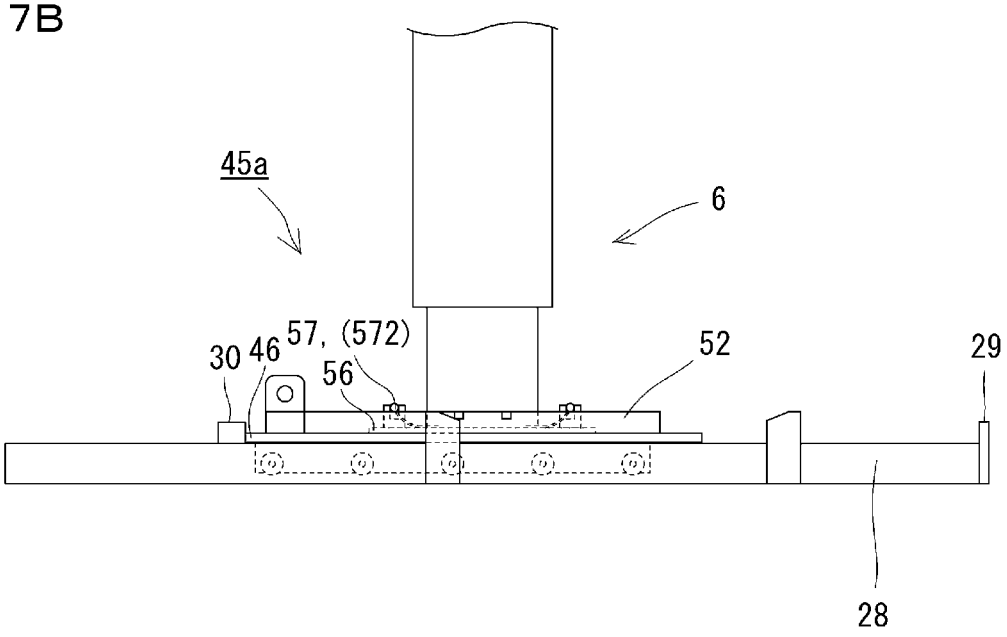

First, as shown in FIG. 6A, with respect to the support strut base portion 45*a* where the first engaging pin 571 on a front side that does not engage with the engaging groove 53 and the second engaging pin 572 on a rear side that engages with the second engaging groove 532 are positioned between two engaging guide members 311, 312, the base 46 and the movable base 56 are integrally movable in the longitudinal direction within a range between both engaging guide members 311,312. That is, this state is a state where the support body 6 that supports the upper body of the care receiver H can perform the translational movement in the longitudinal direction in an interlocking manner with a frontward inclining of the leg guide portion 19 and a rearward inclining of the leg guide portion 19 toward an approximately vertical state.

Then as shown in FIG. 6B to FIG. 7A, when the support body 6 is moved rearward so that the engagement of the second engaging pin 572 on a rear side that is engaged with the second engaging groove 532 is released by the second engaging guide member 312, and the base 46 is brought into contact with the rear stopper 30 thus stopping the movement of the base 46. Then, as shown in FIG. 7B, the movable base 56 is disconnected from the base 46, and a state is brought about where the movable base 56 can move rearward alone. That is, the support body 6 can perform the translational movement in the longitudinal direction without being interlocked with an inclined state of the leg guide portion 19.

Figure 8A:
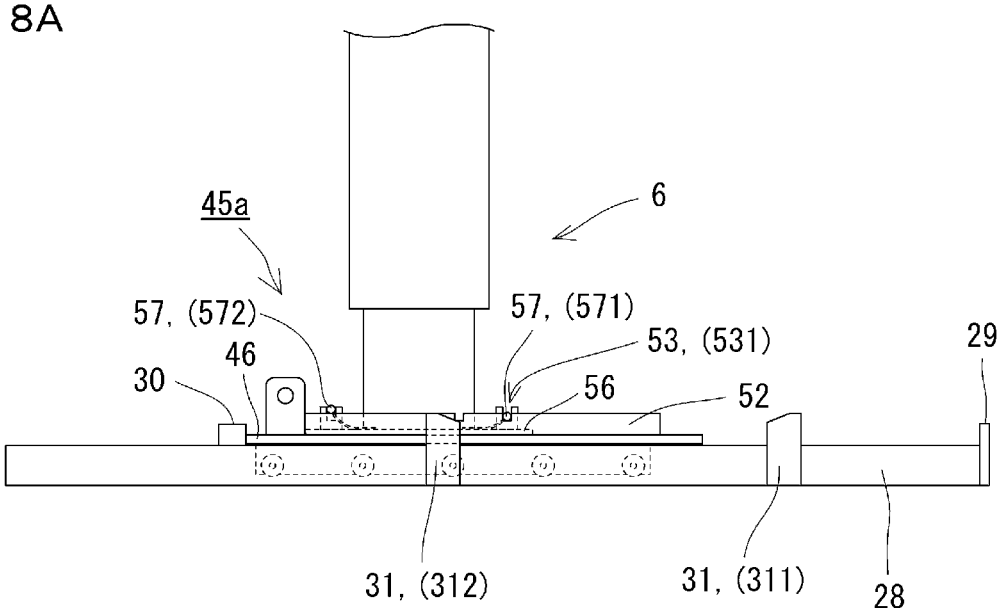
FIG. 8A and FIG. 8B are explanatory side views showing the relationship of the engaging pins and the like that changes depending on the position of the support strut base portion of the transfer device according to the embodiment.

When the movable base 56 is moved further backward, as shown in FIG. 8A, the first engaging pin 571 engages with the first engaging groove 531. In this state, the base 46 and the movable base 56 are integrally movable in the longitudinal direction again. That is, when the second engaging pin 572 moves rearward beyond the second engaging guide member 312, the support body 6 can perform the translational movement in the longitudinal direction without being interlocked with an inclined state of the leg guide portion 19 in a region behind the second engaging guide member 312. On the other hand, when the movable base 56 reaches a rear portion of the base 46, the support body 6 can again perform the translational movement in the longitudinal direction in an interlocking manner with an inclined state of the leg guide portion 19.

Figure 8B:
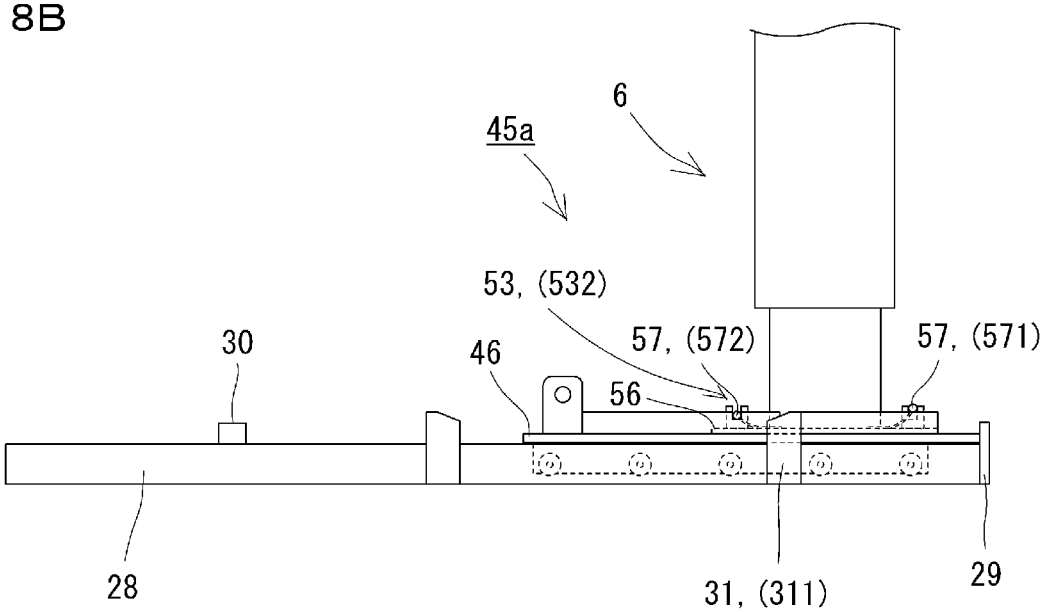

Further, in moving the support body 6 positioned on a rear side as described above to a front side as shown in FIG. 8B in an interlocking manner with frontward inclining of the leg guide portion 19, the engagement of the first engaging pin 571 that engages with the first engaging groove 531 is released by the first engaging guide member 311 and the base 46 is brought into contact with the sealing member 29 so that the movement of the base 46 is stopped. Then, the movable base 56 is disconnected from the base 46 and is brought into a state where the movable base 56 can move frontward alone. When the movable base 56 is further moved frontward, as shown in FIG. 8B, the second engaging pin 572 engages with the second engaging groove 532, and the base 46 and the movable base 56 are integrally movable again in such a state in the longitudinal direction. That is, when the first engaging pin 571 frontward beyond the first engaging guide member 311, the support body 6 can perform the translational movement in the longitudinal direction without being interlocked with an inclined state of the leg guide portion 19 in a region in front of the first engaging guide member 311. On the other hand, when movable base 56 reaches a front portion of the base 46, the support body 6 can again perform the translational movement in the longitudinal direction in an interlocking manner with an inclined state of the leg guide portion 19.

To briefly describe the above-mentioned behaviors from a viewpoint of the relationship with the position of the support body 6, within a range that the support body 6 can move in the longitudinal direction, until the support body 6 moves from the rearmost end to the front side and the first engaging pin 571 passes the first engaging guide member 311, the support body 6 can perform the translational movement in a frontward direction in an interlocking manner with the frontward inclining of the leg guide portion 19. Then, until the support body 6 reaches the frontmost end, the support body 6 can perform the translational movement in the longitudinal direction without being interlocked with an inclined state of the leg guide portion 19.

Further, within the range that the support body 6 can move in the longitudinal direction, during a stage where the support body 6 moves from the frontmost end to the rear side and the second engaging pin 572 passes the second engaging guide member 312, the support body 6 performs the translational movement in a rearward direction in an interlocking manner with an inclined state of the leg guide portion 19 until the leg guide portion 19 returns to an approximately vertical state and, then, the support body 6 can perform the translational movement in the longitudinal direction without being interlocked with an inclined state of the leg guide portion 19 until the support body 6 reaches the rearmost end.

In the case of the support strut base portion 45 that forms the basic configuration of the support body advancing and retracting mechanism 27 of the present invention shown in FIG. 3, the support body 6 always directly moves in an interlocking manner with an inclined state of the leg guide portion 19 on a one-to-one basis.

Figure 11:
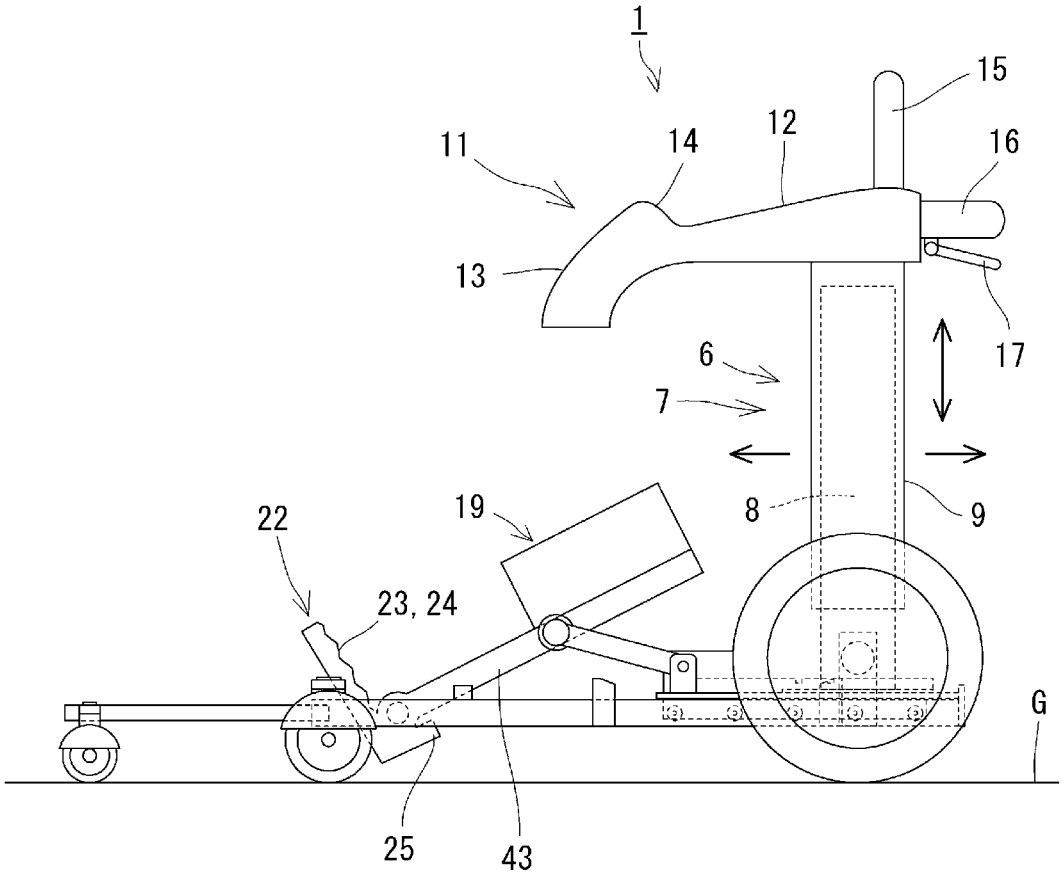
FIG. 11 is a side view for describing a longitudinal movement and a vertical shift of a support body of the transfer device according to the embodiment.

Next, as shown in FIG. 2 and FIG. 11, the leg guide portion 19 extends between upper surfaces of upper half portions of the rear inclined stays 43 that are positioned parallel to each other in a lateral direction such that two rear inclined stays 43 are integrally joined to each other. In the same manner, the foot placing portion 22 is interposed between inner sides of lower end edges of the rear inclined stays 43 such that two rear inclined stays 43 are integrally joined to each other.

The leg guide portion 19 is formed in a W shape in cross section so as to allow lower legs of a human body to be approximately fitted in and guided by the leg guide portion 19. That is, two guide grooves 20 that are disposed parallel to each other in a lateral direction are formed in the leg guide portion 19 such that the guide grooves 20 extend in a longitudinal direction in a concave state.

In this embodiment, to reduce a load applied to the lower legs that are approximately fitted in and are brought into contact with the guide grooves 20, at least peripheries of the guide grooves 20 are formed of an elastic material such as urethane.

The foot placing portion 22 is integrally fixed to inner side surfaces of the rear inclined stays 43 formed on left and right sides of the transfer device 1. The foot placing portion 22 is formed of a foot placing member 23 having an approximately flat shape and a restricting member 25 having a front side that is bent upward at an approximately right angle. A slip preventing portion 24 is formed on an upper surface of the foot placing member 23. The slip preventing portion 24 has a wave shape in side cross section that is formed of a plurality of concaves and convexes extending laterally and arranged in a longitudinal direction. The restricting member 25 is formed so as to prevent the removal of front portions of feet placed on the foot placing portion 22 frontward from the foot placing portion 22.

As described above, in the support body advancing and retracting mechanism 27, the leg guide portion 19 and the foot placing portion 22 are connected to each other. Accordingly, when the lower leg front surfaces f of the care receiver H incline and push the leg guide portion 19 frontward or retract the leg guide portion 19 with the help of the care giver, the support body advancing and retracting mechanism 27 can allow the support body 6 to perform the translational movement in the longitudinal direction in an interlocking manner with an inclined state of the rear inclined stay 43 in the longitudinal direction.

The number, the positions, the structure and the like of the wheels are not limited to the above-mentioned embodiment.

As shown in FIG. 1, on the inner sides of a front end side of the rail portions 28, the reinforcing member 34 having a rectangular plate shape is interposed between two rail portions 28 disposed parallel to each other. The reinforcing member 34 enhances a strength of the transfer device 1.

Figure 13:
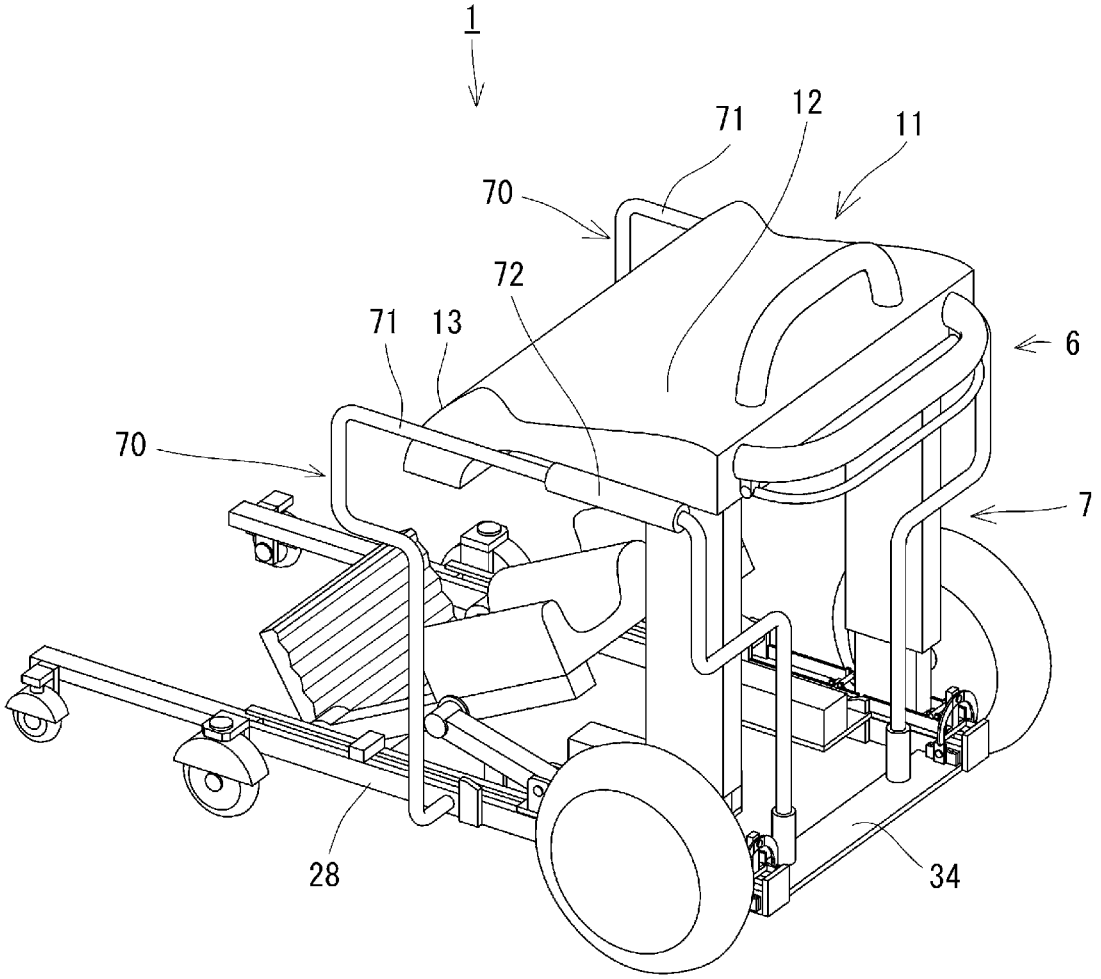
FIG. 13 is a perspective view showing one example of the enhancement of a strength of the transfer device according to the embodiment as viewed from an upper side.

A means for enhancing a strength of the transfer device 1 is not limited to the means described in the embodiment. For example, as shown in FIG. 13, the reinforcing guides 70 each formed of a round rod that are bent and extend from an upper surface of a reinforcing member 34 to outer side surfaces of the rail portions 28 may be formed.

The reinforcing guide 70 is erected vertically from the upper surface of the reinforcing member 34, is bent toward the outside at an approximately right angle at an approximately center of the support struct portion 7, is bent vertically in the vicinity of an outer side edge of the upper body guide portion 11, is bent approximately horizontally and extends to a position beyond an outer side edge of the chest contact portion 13 rearward, is bent vertically downward, is bent slightly frontward, is bent vertically downward, and is bent toward the rail portion 28 just on a lateral side of an outer side surface of the rail portion 28, and is connected to the rail portion 28.

A portion that is formed by extending approximately horizontally to a position beyond the outer side edge of the chest contact portion 13 rearward thus forming an upper portion of the reinforcing guide 70 forms a slide reinforcing portion 71. The slide reinforcing portion 71 is inserted into a slide member 72 integrally connected to the outer side edge of the arm placing portion 12 and having a circular cylindrical shape.

A length of the slide reinforcing portion 71 is approximately equal to a longitudinal length of the support body 6. By approximately integrally connecting the reinforcing guides 70 disposed on both sides of the transfer device 1 to each other by way of the support body 6, a strength of the transfer device 1 can be enhanced.

The reinforcing guide 70 can also be used as a hand rail by the care receiver H and hence, the reinforcing guide 70 also contributes to the safety of the care receiver H.

As a means for enhancing a strength of the transfer device 1, various modifications and alterations are conceivable such as mounting of the rail portions 28 on a large-sized plate member such as a general-use hand cart.

As shown in FIG. 2 and FIG. 11, the support body 6 is formed of: two support strut portions 7 erected upright parallel to each other in the lateral direction; and the upper body guide portion 11 that extends between the upper ends of the support strut portions 7. The support strut portion 7 is formed of a lower support strut 8 formed from an angular rod and an upper support strut 9 formed from an angular columnar pipe that encases the lower support strut 8 in a vertically slidable manner. The support body 6 also includes an engaging portion not shown in the drawing that can substantially fix the upper support strut 9 at a desired height with respect to the lower support strut 8.

For example, the engaging portion may be formed of: engaging lower holes that are formed in a side surface of the lower support strut 8 at a predetermined pitch vertically; engaging upper holes that are formed in a side surface of the upper support strut 9 at the same pitch as the engaging lower holes vertically; and an engaging pin that is inserted into both holes so as to fix the lower support strut 8 and the upper support strut 9 to each other. By adopting such holes and engaging pins, a length of the support strut portion 7 can be changed.

In this manner, by forming the support strut portion 7 of the support body 6 in a vertically adjustable manner, it is possible to adjust the transfer device 1 at a most suitable height corresponding to a physical structure of the care receiver H and hence, general-use property of the transfer device 1 can be enhanced.

The upper body guide portion 11 is formed of: the arm placing portion 12 that is formed approximately horizontally; the chest contact portion 13 that is gradually inclined rearwardly downward and is connected to an end portion of the arm placing portion 12; and an elbow engaging portion 14 that has a hook shape as viewed in a side view formed on the chest contact portion 13 at the rear end portion of the arm placing portion 12 so as to make the upper end edge of the chest contact portion 13 protrude upward with respect to the rear end portion of the arm placing portion 12.

In this embodiment, to reduce a load applied to the front arms and the elbows that are placed on the arm placing portion 12 and the chest that is brought into contact with the chest contact portion 13, at least an upper half portion of the upper body guide portion 11, that is, a portion of the arm placing portion 12 and a portion of the chest contact portion 13 in the vicinity of surfaces of these parts are made of an elastic material such as urethane.

The grip portion 15 is formed at a center of an upper surface of a front portion of the arm placing portion 12. The grip portion 15 is formed such that both end portions of a round rod that extends laterally and is bent in an approximately downward U shape as viewed in a front view are connected to the arm placing portion 12 in an uprightly erected manner. The handle portion 16 is formed on an end surface of the front side of the arm placing portion 12. The handle portion 16 is formed such that both end portions of a round rod that extends laterally and is bent in an approximately U shape as viewed in a plan view are connected to the arm placing portion 12 in a protruding manner. With such a configuration, the care receiver H who is transferred to the transfer device 1 can easily grip the grip portion 15 in a state where the front arms are placed on the arm placing portion 12, and a care giver can easily move the transfer device 1 by pushing or pulling the transfer device 1 while gripping the handle portion 16.

As shown in FIG. 12, the upper body guide portion 11 is formed in an advancing and retracting manner longitudinally in the approximately horizontal direction. For example, a slide portion such as a slide bearing may be formed between a lower side surface of the upper body guide portion 11 and an upper end surface of the support strut portion 7, an engaging hole may be formed in the lower side surface of the upper body guide portion 11, and an engaging portion that is vertically advanceable and retractable and is inserted into and fixed to the engaging hole may be formed on a portion of an upper peripheral side surface of the support strut portion 7 in a protruding manner. With such a configuration, the upper body guide portion 11 can be advanced or retracted longitudinally in the approximately horizontal direction, and the upper body guide portion 11 can be approximately fixed at a predetermined position.

An advancing and retracting restriction portion 17 that is formed approximately in the same shape as the handle portion 16 is formed on a lower portion of the handle portion 16. The advancing and retracting restriction portion 17 has a smaller diameter than the handle portion 16. The advancing and retracting restriction portion 17 is formed so as to be vertically movable using both end portions of the advancing and retracting restriction portion 17 as proximal ends.

The advancing and retracting restriction portion 17 is configured such that when the advancing and retracting restriction portion 17 is operated upward once, braking is applied so as to stop the rotation of the front wheels 2, and the advancing and retracting restriction portion 17 returns downward, and when the advancing and retracting restriction portion 17 is operated upward again, braking is released, and the advancing and retracting restriction portion 17 returns downward. With such a configuration, the care giver can easily operate the advancing and retracting restriction portion 17 while gripping the handle portion 16, and can maintain effective braking even when the care giver moves away from the transfer device 1.

That is, when braking is applied, even when a care giver grips only the handle portion 16 and pushes or pulls the transfer device 1, it is impossible to move the transfer device 1 since braking is applied to the front wheels 2. When the care giver grips the advancing and retracting restriction portion 17 together with the handle portion 16 so that the advancing and retracting restriction portion 17 moves upward, braking applied to the front wheels 2 is released and hence, the care giver can freely move the transfer device 1.

The transfer device 1 according to this embodiment is configured to be operated by operating the advancing and retracting restriction portion 17 as described above. However, the present invention is not limited to such a configuration.

A support body brake handle not shown in the drawings for operating the support body brake 49 described above can be disposed on the support body 6 at a desired position at that a care giver can easily operate the support body brake handle.

The shape and the number of the support strut portions 7, the shape of the upper body guide portion 11, the positions, the number, the shape and the like of the grip portion 15, the handle portions 16 and the like are also not limited to such shapes and numbers in the embodiment described above, and it is needless to say that the configuration where the respective parts of the transfer device 1 are electrically driven also falls within the scope of the gist of the present invention.

Next, one example of the method of using the transfer devices 1 according to the above-mentioned embodiment is briefly described.

In the description made hereinafter, a plurality of steps of operating the transfer device 1 including the support body advancing and retracting mechanism 27 that forms the support strut base portion 45*a* in the longitudinal direction is described. The explanation is also made with respect to an operation of applying braking to the front wheel 2 using the advancing and retracting restriction portion 17.

Figure 9A:
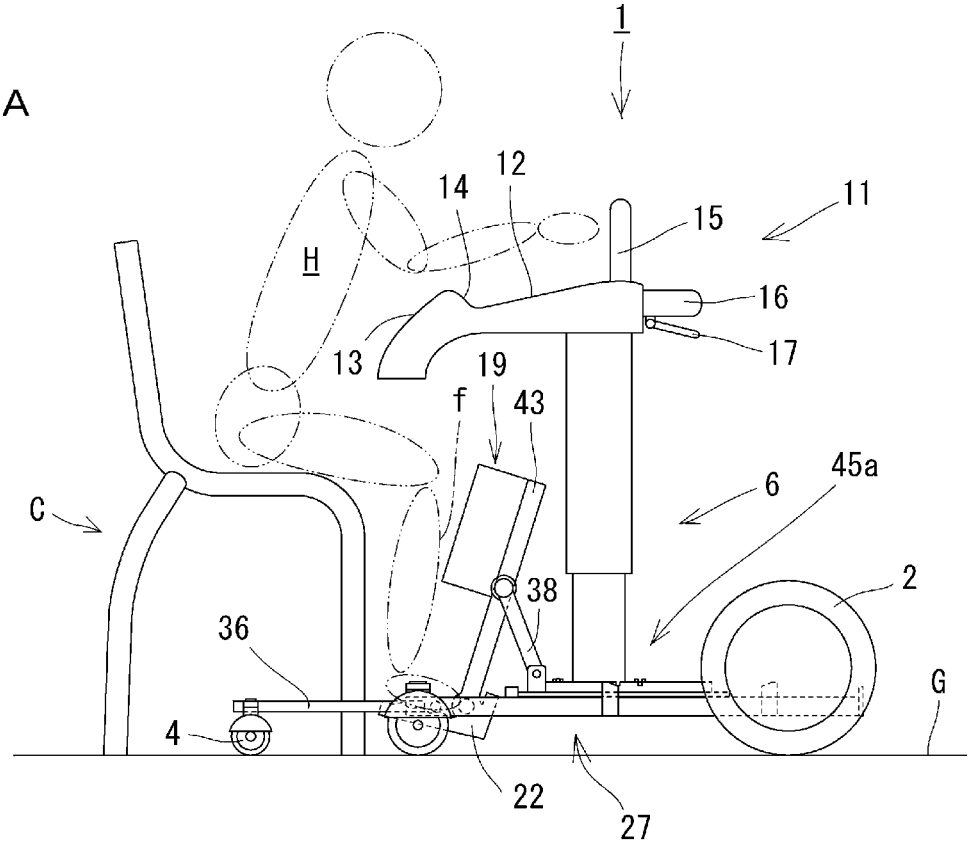
FIG. 9A is an explanatory view showing a mode where a care receiver gets on or off the transfer device according to the embodiment.

First, as shown in FIG. 9A, the transfer device 1 where the leg guide portion 19 is in an approximately vertical state and the support body 6 is positioned at a rearmost end is moved to a position in front of a care receiver H being seated on a chair C. Then, braking is applied to the front wheels 2 by gripping the handle portion 16 and the advancing and retracting restriction portion 17.

This state is a state where the first engaging pins 571 engage with the first engaging grooves 531 so that the movable base 56 is integrally formed with the base 46 (see FIG. 8A).

Next, the care receiver H places both feet on the foot placing portion 22, and extends both arms and grips the grip portion 15.

Figure 9B:
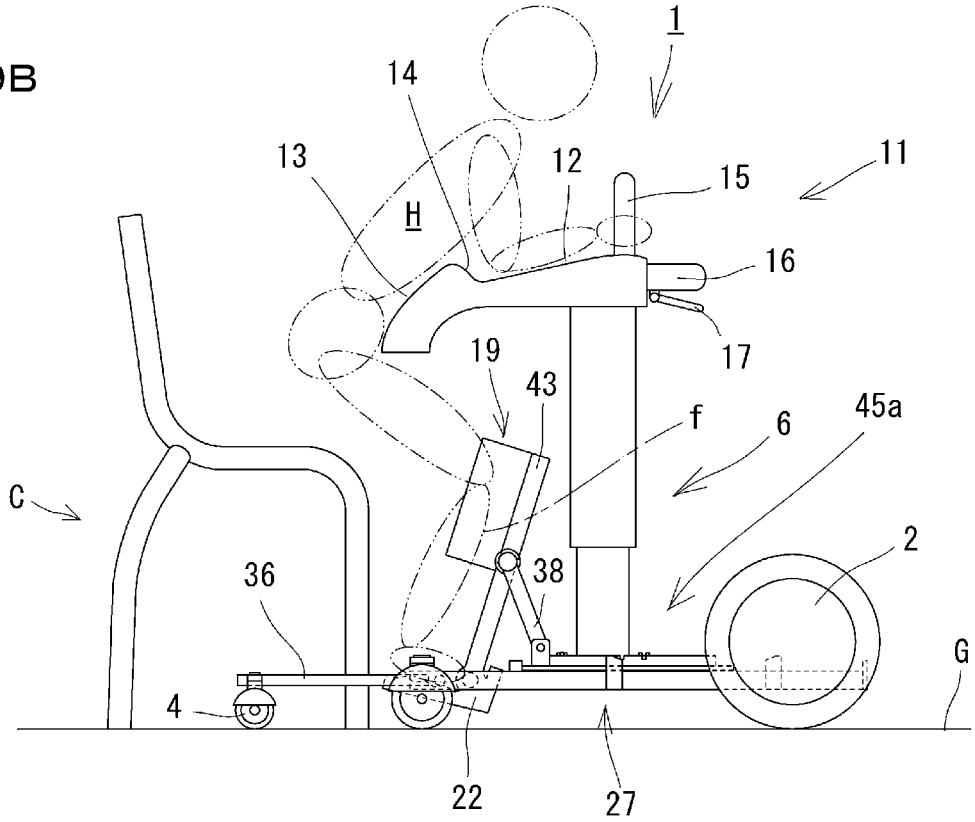
FIG. 9B is an explanatory view showing a mode immediately before and after the mode shown in FIG. 9A.

Then, as shown in FIG. 9B, the care receiver H holds the grip portion 15 as a fulcrum and makes his/her body approach the transfer device 1 by the strength of his/her arms, places his/her front arms on the arm placing portion 12, and brings his/her lower leg front surfaces f into contact with the leg guide portion 19.

When the arm strength of the care receiver H is weak, a care giver helps the care receiver H.

Figure 10A:
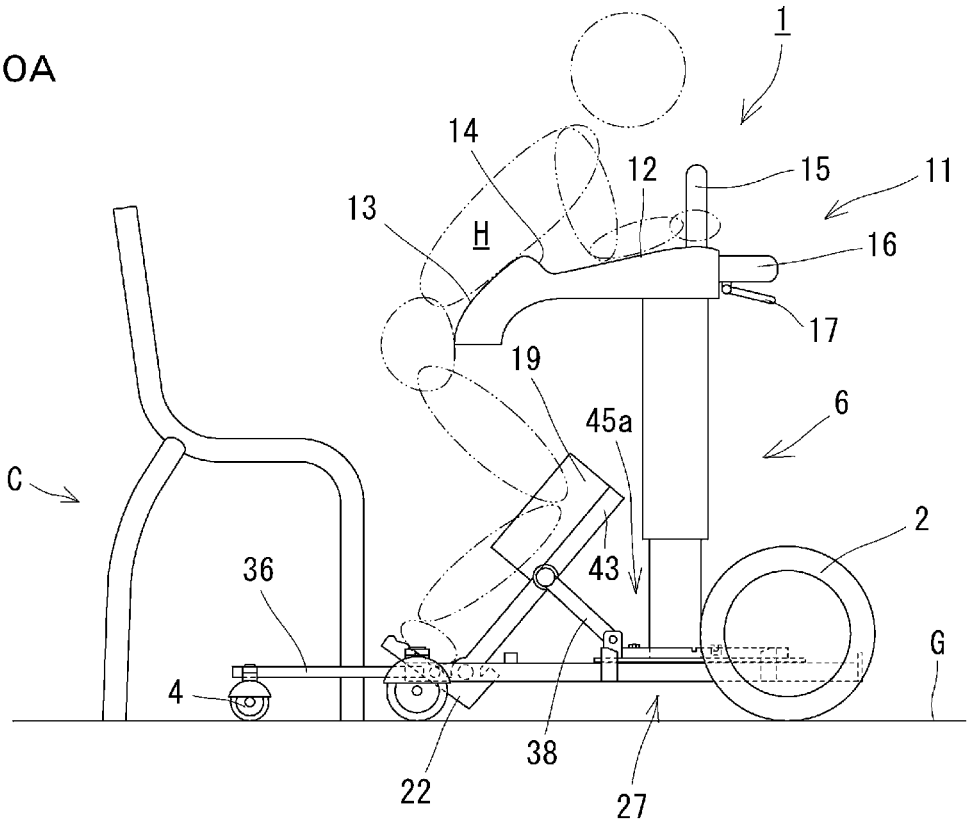
FIG. 10A is a mode immediately before and after the mode shown in FIG. 9B.

Next, as shown in FIG. 10A, the care receiver H brings his/her upper body into contact with the upper body guide portion 11 so as to lean on the upper body guide portion 11 with his/her upper body, and the care receiver H leans on the leg guide portion 19 with his/her lower leg front surfaces f so that the leg guide portion 19 is inclined frontward due to its own weight. With such frontward inclining of the leg guide portion 19, the support body 6 performs the translational movement in the forward direction in an interlocking manner.

In this case, the care giver carefully operates the transfer device 1 such that the support body 6 slowly moves frontward by gripping the handle portion 16 and, simultaneously, the care giver releases or applies braking using the support body brake 49 by operating a support body brake handle not shown in the drawing.

This state is a state where the first engaging pins 571 engage with the first engaging grooves 531 so that the movable base 56 is integrally formed with the base 46. By moving the support body 6 frontward as it is, the engagement of the first engaging pins 571 is released by the first engagement guide members 311 and hence, the movable base 56 is movable frontward irrelevant to the base 46 so that the posture of the care receiver H easily becomes stable.

Figure 10B:
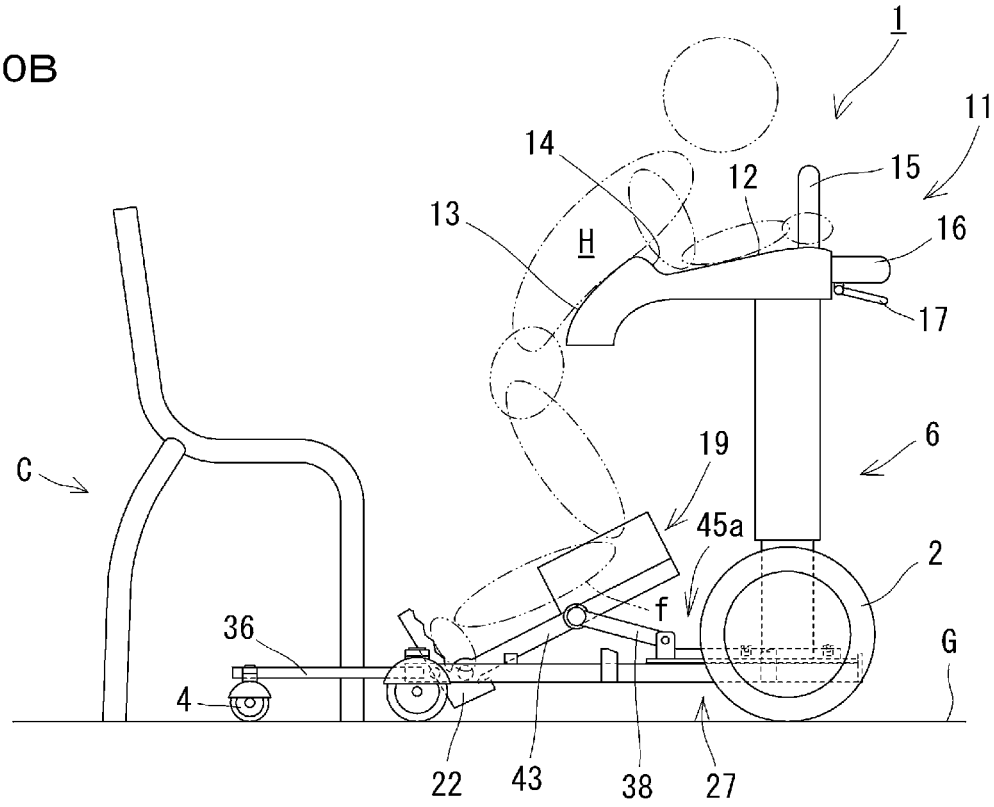
FIG. 10B is an explanatory view showing a mode immediately before and after the mode shown in FIG. 10A.

Then, as shown in FIG. 10B, when the care receiver H strongly brings his/her upper body into contact with the upper body guide portion 11 so as to lean on the upper body guide portion 11, his/her elbows engage with the elbow engaging portion 14 so that the upper body becomes stable. Accordingly, a strength of a lower body of the care receiver H can be decreased and hence, the weight of the care receiver H with that the lower leg front surfaces f of the care receiver H incline the leg guide portion 19 frontward is increased so that the support body 6 moves further frontward.

This state is a state where the engagement of the first engaging pins 571 is released by the first engagement guide member 311 so that the movable base 56 is movable frontward irrelevant to the base 46 and, then, the second engaging pins 572 engage with the second engaging grooves 532 so that the movable base 56 is integrally formed with the base 46 again (see FIG. 8B).

When the support body 6 reaches the frontmost end, the care giver grips the handle portion 16 and pulls the handle portion 16 frontward while keeping releasing of applying braking to the front wheels 2 by gripping both the handle portion 16 and the advancing and retracting restriction portion 17. Accordingly, the care giver can move the transfer device 1 on which the care receiver H rides in a stable state.

As shown in FIG. 12, the transfer device 1 may be moved after sliding the upper body guide portion 11 frontward. In this case, the center of gravity of the transfer device 1 is further dispersed in the horizontal direction and hence, not only the transfer device 1 becomes more stable, but also a back side of the care receiver H is stretched so that the position of his/her buttocks slightly rises and hence, the care receiver H can take a more comfortable posture. Further, in such a state, the care giver can easily perform changing of underwear or the like of the care receiver H on the transfer device 1.

The care giver can move the care receiver H to a desired place by moving the transfer device 1 in this manner.

For example, in a case where the desired place is the chair C that is placed in another place, to make the care receiver H sit on the chair C, as shown in FIG. 10B, the transfer device 1 on which the care receiver H rides is moved in front of the chair C. Then, braking is applied to the front wheels 2 by gripping the handle portion 16 and the advancing and retracting restriction portion 17.

Next, in order to change the posture of the transfer device 1 from the posture shown in FIG. 10B to the posture shown in FIG. 10A, and to the posture shown in FIG. 9B, the care giver pushes the support body 6 in the direction toward the chair C such that the support body 6 slowly moves rearward by releasing or applying braking using the support body brake 49 by gripping the handle portion 16 and, simultaneously, by operating the support body brake handle not shown in the drawing. With such an operation, the leg guide portion 19 can naturally move the entire body of the care receiver H in the direction toward the chair C while lifting the lower legs of the care receiver H.

FIG. 9A to FIG. 10B are views showing an operation for transferring the care receiver H in a seated state to the transfer device 1. Since an operation to bring the care receiver H into a seated state that is a reverse operation is described using these drawings, originally, in FIG. 10A, the positional relationship between the base 46 and the support body 6 is equal to the positional relationship in FIG. 10B. On the other hand, thereafter, the engagement of the second engaging pins 572 is released by the second engagement guide members 312 so that the movable base 56 is movable rearward irrelevant to the base 46 and, thereafter, the first engaging pins 571 engage with the first engaging grooves 531 so that a state is brought about where the movable base 56 is again integrally formed with the base 46. Accordingly, in FIG. 9A and FIG. 9B, the substantially same state are shown in bringing the care receiver H into a seated state.

In this case, the care giver can also operate the support body brake handle while giving a care to the care receiver H while moving along side of the care giver H.

Then, when the care giver further pushes the transfer device 1 in the direction toward the chair C, the leg guide portion 19 is brought into an approximately vertical state. Accordingly, as shown in FIG. 9A, the care receiver H releases his/her hands from the grip portion 15, and can sit on the chair C.

In the case where the upper body guide portion 11 is slid frontward, by sliding the upper body guide portion 11 rearward immediately before the care receiver H sits on the chair C, it is possible to make the position of the buttocks of the care receiver H approach a seating surface at a final stage and hence, the care receiver H can maintain a comfortable posture until the care receiver H takes the final position.

As has been described above, the transfer device 1 according to this embodiment is capable of moving a care receiver H by a care giver. The transfer device 1 includes: the front wheels 2 and the rear wheels 3; the support body 6 that supports the upper body of the care receiver H; the leg guide portion 19 that is brought into contact with the lower leg front surfaces f of the care receiver H and is inclinable frontward from an approximately vertical state; the foot placing portion 22 on which soles of the care receiver H are placed; and the support body advancing and retracting mechanism 27 that is configured to allow the support body 6 to perform a translational movement in a frontward direction in an interlocking manner with frontward inclining of the leg guide portion 19. With such a configuration, in transferring the care receiver H, when the care receiver H simply brings lower leg front surfaces that form his/her lower body into contact with the leg guide portion 19 and leans on the leg guide portion 19 with his/her weight while gripping the support body 6, the support body 6 performs the translational movement in a frontward direction, and the care receiver H can also naturally lean on the support body 6 with his/her upper body. Accordingly, the upper and lower bodies of the care receiver H are supported at two points and hence, the stable posture of the care receiver H on the transfer device 1 is ensured.

Further, the support body 6 performs a translational movement in a frontward direction and hence, there is no possibility that the head of the care receiver H is directed downward. Accordingly, the upper body of the care receiver H takes the stable posture substantially equal to the seated posture that the care receiver H takes before the transfer operation and hence, the care receiver H can maintain a comfortable posture during movement of the transfer device 1.

Further, in taking the care receiver H off the transfer device 1, it is possible to bring the lower legs of the care receiver H into an approximately upright state by merely pushing the support body 6 in a sitting direction and hence, the care receiver H can be seated in an extremely natural and comfortable posture.

Further, the support body 6 performs the translational movement in the frontward direction and in the backward direction without being interlocked with frontward inclining of the leg guide portion 19 in the predetermined region where the support body 6 performs the translational movement in a frontward direction in an interlocking manner with the frontward inclining of the leg guide portion 19. Accordingly, a movable range of the support body 6 is expanded and hence, in transferring the care receiver H to the transfer device 1 or during movement of the transfer device 1, the care receiver H can maintain the more comfortable posture when the care receiver H is transferred to the transfer device 1 or during movement of the transfer device 1. Such a structure is also effective in smoothly taking the care receiver H off the transfer device 1.

The support body 6 is formed of the support strut portions 7 that are erected upright and the upper body guide portion 11 that is disposed on the upper ends of the support strut portions 7, and the upper body guide portion 11 includes the grip portion 15 that the care receiver H grips and the handle portion 16 that the care giver grips for moving the transfer device 1. With such a configuration, in transferring the care receiver H to the transfer device 1 and during the movement of the transfer device 1, the care receiver H can prevent himself/herself from falling from the transfer device 1 by merely gripping the grip portion 15 thus ensuring safety. Further, the care giver can safely operate the transfer device 1 by merely gripping the handle portion 16.

The upper body guide portion 11 includes: the arm placing portion 12 that is formed approximately horizontally and on which the care receiver H places his/her elbows to front arms; the chest contact portion 13 that is brought into contact with a chest of the care receiver H, is inclined rearwardly downward, and is connected to a rear portion of the arm placing portion 12; and the elbow engaging portion 14 that is formed on the chest contact portion 13 as an integral part of the chest contact portion 13 at the rear portion of the arm placing portion 12 so as to make the upper end edge of the chest contact portion 13 protrude upward with respect to the rear end portion of the arm placing portion 12. With such a configuration, in transferring the care receiver H to the transfer device 1 and during the movement of the transfer device 1, the care receiver H can make his/her elbows engage with the elbow engaging portion 14 by merely placing his/her front arms on the arm placing portion 12 and hence, the care receiver H can stably lean on the transfer device 1 with his/her upper body.

The front arms of the care receiver H are placed on the substantially horizontal arm placing portion 12 and hence, the upper body of the care receiver H is not frontwardly inclined more than necessary and hence, the care receiver H can maintain a comfortable posture during the movement of the transfer device 1.

The upper body guide portion 11 is formed in an advancing and retracting manner longitudinally in the approximately horizontal direction. Accordingly, the center of gravity of the care receiver H with respect to the transfer device 1 is adjustable. Further, the posture of the care receiver H with respect to the transfer device 1 is adjustable. Still further, in making the care receiver H sit on a predetermined place, by pushing the upper body guide portion 11 rearward in a final step, it is possible to make a seating object such as a chair and buttocks of the care receiver H approach each other smoothly in a comfortable posture during the movement of the transfer device.

Further, the support body advancing and retracting mechanism 27 includes the support body brake 49 configured to stop the translational movement of the support body 6. Accordingly, the care giver can perform an operation of transferring the care receiver H to the transfer device 1 and an operation of taking the care receiver H off the transfer device 1 while adjusting an amount of translational movement of the support body 6 in an interlocking manner with a degree of inclination of the lower legs of the care receiver H.

The transfer device includes the brakes that stop the rotation of at least the front wheels 2 and hence, safety of the transfer device can be enhanced.

The preferred embodiment of the transfer device 1 according to the embodiment of the present invention has been described heretofore. However, the present invention is not limited to the specific embodiment, and various modifications and alterations are conceivable.

REFERENCE SIGN LIST f: lower leg front surface
G: floor
H: care receiver
1: transfer device
2: front wheel
3: rear wheel
6: support body
7: support strut portion
11: upper body guide portion
12: arm placing portion
13: chest contact portion
14: elbow engaging portion
15: grip portion
16: handle portion
19: leg guide portion
22: foot placing portion
27: support body advancing and retracting mechanism
49: support body brake

The invention claimed is:

1. A transfer device capable of moving a care receiver by a care giver, the transfer device comprising:

a front wheel and a rear wheel;

a support body configured to support an upper body of the care receiver;

a leg guide portion configured to be brought into contact with lower leg front surfaces of the care receiver and configured to be inclined frontward from an approximately vertical state;

a foot placing portion on which soles of the care receiver are placed; and a support body advancing and retracting mechanism configured to allow the support body to perform a translational movement in a frontward direction in an interlocking manner with frontward inclining of the leg guide portion and configured to allow the support body to perform the translational movement in a longitudinal direction without being interlocked with frontward inclining of the leg guide portion in a predetermined region where the support body performs the translational movement.

2. The transfer device according to claim 1, wherein the support body is formed of a support strut portion erected upright and an upper body guide portion disposed on an upper end of the support strut portion, and the upper body guide portion includes a grip portion that the care receiver grips and a handle portion that the care giver grips for moving the transfer device.

3. The transfer device according to claim 2, wherein the upper body guide portion includes: an arm placing portion formed approximately horizontally, the arm placing portion on which the care receiver places his/her elbows to front arms; a chest contact portion configured to be brought into contact with a chest of the care receiver and being inclined rearwardly downward, the chest contact portion being connected to a rear portion of the arm placing portion; and an elbow engaging portion that is formed on the chest contact portion as an integral part of the chest contact portion at the rear portion of the arm placing portion so as to make an upper end edge of the chest contact portion protrude upward with respect to a rear end portion of the arm placing portion.

4. The transfer device according to claim 1, wherein the support body advancing and retracting mechanism includes a support body brake configured to stop the translational movement of the support body.

* * * * *